US008898983B2

(12) United States Patent
Fu

(10) Patent No.: US 8,898,983 B2
(45) Date of Patent: Dec. 2, 2014

(54) WAFFLE SLAB INTERLOCKING WALL

(76) Inventor: Liming Fu, Wuhan (CN)

( * ) Notice: Subject to any disclaimer, the term of this patent is extended or adjusted under 35 U.S.C. 154(b) by 0 days.

(21) Appl. No.: 13/592,302

(22) Filed: Aug. 22, 2012

(65) Prior Publication Data

US 2013/0047535 A1 Feb. 28, 2013

(30) Foreign Application Priority Data

Aug. 26, 2011 (CN) ..... 2011 1 0248971

(51) Int. Cl.

| | |
|---|---|
| ***E04B 2/06*** | (2006.01) |
| ***E04B 1/80*** | (2006.01) |
| ***E04C 1/40*** | (2006.01) |
| ***E04C 2/38*** | (2006.01) |
| *E04B 1/76* | (2006.01) |
| *E04B 2/64* | (2006.01) |
| *E04B 2/02* | (2006.01) |

(52) U.S. Cl.

CPC ... *E04B 1/80* (2013.01); *E04C 1/40* (2013.01); *E04C 2/382* (2013.01); *E04C 2/384* (2013.01); *E04B 1/7604* (2013.01); *E04B 2/64* (2013.01); *E04B 2002/0206* (2013.01)

USPC ..... 52/481.1; 52/309.12; 52/428; 52/483.1

(58) Field of Classification Search

CPC ..... E04B 2/56; E04B 2/64; E04B 2/68; E04B 2/70; E04B 2/74; E04B 2/88; E04B 1/80; E04B 1/7604; E04B 2/7457; E04B 2/7412

USPC ..... 52/309.1, 309.12, 309.11, 428, 483.1, 52/582.1, 455, 456, 479, 481.1

See application file for complete search history.

(56) References Cited

U.S. PATENT DOCUMENTS

| | | | | |
|---|---|---|---|---|
| 3,313,073 | A * | 4/1967 | Mathews | 52/309.2 |
| 3,785,913 | A * | 1/1974 | Hallamore | 28/71 |
| 4,054,033 | A * | 10/1977 | Pillosio | 405/282 |
| 5,524,402 | A * | 6/1996 | Sykes | 52/243.1 |
| 5,609,006 | A * | 3/1997 | Boyer | 52/481.1 |
| 5,927,032 | A * | 7/1999 | Record | 52/309.11 |
| 6,065,259 | A * | 5/2000 | Clear | 52/284 |
| 6,189,270 | B1 * | 2/2001 | Jeffers et al. | 52/220.7 |
| 6,189,282 | B1 * | 2/2001 | VanderWerf | 52/582.1 |
| 6,510,807 | B2 * | 1/2003 | Gottfried | 114/78 |
| 7,127,865 | B2 * | 10/2006 | Douglas | 52/745.13 |
| 7,546,716 | B1 * | 6/2009 | Asadurian | 52/570 |
| 7,669,372 | B2 * | 3/2010 | Schaffer | 52/309.7 |
| 2006/0010810 | A1 * | 1/2006 | Muszynski | 52/503 |

* cited by examiner

*Primary Examiner* — Brian Glessner
*Assistant Examiner* — Adam Barlow
(74) *Attorney, Agent, or Firm* — Novoclaims Patent Services LLC; Mei Lin Wong

(57) ABSTRACT

A waffle slab interlocking wall, including slab columns, slab beams, and interlocking building blocks. At least one interlocking building block is embedded in a space enclosed by at least one slab column and at least two slab beams or by at least two slab columns and at least one slab beam. The interlocking building block includes an external faceplate and an internal faceplate which are spliced by a connecting piece.

4 Claims, 23 Drawing Sheets

WAFFLE SLAB INTERLOCKING WALL

CROSS-REFERENCE TO RELATED APPLICATIONS

Pursuant to 35 U.S.C. §119 and the Paris Convention Treaty, this application claims the benefit of Chinese Patent Application No. 201110248971.4 filed Aug. 26, 2011, the contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 14781 Memorial Drive, Suite 1319, Houston, Tex. 77079.

BACKGROUND OF THE INVENTION

1. Field of the Invention

The invention relates to a building enclosure component, and more particularly to an assembled waffle slab interlocking wall with the functions of thermal insulation, fireproof protection, and shock resistance.

2. Description of the Related Art

In recent years, various wall materials such as cavity bricks, interlocking bricks, aerated concrete bricks, steel mesh sandwich bricks, nanometer straw bricks, and EPS concrete bricks have been developed, with advantages as follows:

1. The clay is not used as the raw material, and the wastes are recycled to some extent;

2. The concept of thermal insulation and energy saving is introduced. Some wall materials adopt a combined structure capable of external thermal insulation or internal thermal insulation, some wall materials include cavities for filling thermal insulating materials, and some wall materials are directly processed into the materials (such as foam concrete, aerated concrete and the like) with certain thermal insulating property;

3. An energy-saving method that a thermal insulating material (such as polyphenyl plate) is stuck to the external wall is widely applied; and 4. The wall construction process matched with the novel wall material is ceaselessly updated.

However, these wall materials have the following deficiencies:

1. With poor strength, the wall materials made of wastes or biomaterials are not suitable for bearing walls;

2. The walls with external thermal insulation and internal thermal insulation have potential fire hazard;

3. The wall materials with thermal insulation layers positioned at the interlayers cannot solve the problem of cold bridge;

4. The wall construction process is complex, and the construction quality is difficult to control; and 5. As the separating component and external enclosure component, the wall cannot resist earthquake, which generally makes people hurt and dead in case of natural disaster.

Therefore, it is urgent to develop a novel wall material and wall made of wastes, with properties of light weight, high strength, simple construction process, excellent thermal insulating, and earthquake and typhoon resistance.

SUMMARY OF THE INVENTION

In view of the above-described problems, it is one objective of the invention to provide a waffle slab interlocking wall which is formed by assembling interlocking building blocks with staggered waffle slabs (slab columns and slab beams).

To achieve the above objective, in accordance with one embodiment of the invention, there is provided a waffle slab interlocking wall comprising slab columns, slab beams, and interlocking building blocks. At least one interlocking building block is embedded in a space enclosed by at least one slab column and at least two slab beams or by at least two slab columns and at least one slab beam, and the interlocking building block comprises an external faceplate and an internal faceplate which are spliced by a connecting piece.

The crisscross-distributed invisible lattice frame structure formed by the slab columns and the slab beams is a high strength bearing mechanism for the wall of the invention, is a main structure for resisting typhoon and earthquake, and is also a main mechanism for separating the wall, forming the regional fire control to prevent the high temperature from transferring and spreading in case of fire. Adopting the bearing system of the invisible lattice frame structure with the waffle slab is the characteristic of the invention, and the invention has the following advantages: firstly, the bearing system takes a share in building stress, can be jointed and fixed with the components of the building into a whole and can serve as a bearing wall and shear wall, and the stability, rigidity and strength of the wall with the bearing system are much better than that of the wall without the bearing system; secondly, the bearing system has strong horizontal shock resistance. When the bearing system is used in the area where typhoon and earthquake occur frequently, the lattice structure can effectively disperse the impact force towards the transverse and longitudinal directions, and the shear resistant and impact bearing capacities of the wall with the bearing system are much better than that of the common wall without the bearing system. In case of fire, the invention utilizes the advantages of the lattice structure, a reticular lattice which is interlaced with the slab beams and the slab columns made of flame retardant and thermal insulating materials are adopted to naturally form various small closed subareas in combination with the external and internal faceplates and the internal thermal insulating materials, so that even if local subareas are molten down, other subareas cannot be impacted to prevent and postpone high temperature transfer and gain time for rescue and escape, which is the advantage of subarea fire control of the invention.

The interlocking building blocks are embedded in the space enclosed by the slab columns and the slab beams to form an internal wall and thus has a simple structure. The interlocking building blocks can form a closed airtight system, or combined with others to form a wall system. The interlocking building block has a simple construction process, adopts the splicing installation, and can completely achieve the water free and dust free operation and meets the requirements of sanitation and environmental protection; the hollow structure of the interlocking building block greatly reduces the wall weight, and the light weight requirement for the material selection of the high-rise building can be better achieved.

In a class of this embodiment, a thermal insulation layer is arranged between the external faceplate and the internal faceplate of the interlocking building block. With the thermal insulation layer, the energy-saving, consumption reduction, thermal insulation, and sound insulation properties of the wall can be greatly improved.

In a class of this embodiment, the thermal insulation layer is a polyphenylene compound, polystyrene, phenolic resin, foamed cement, or air, and is a prefabricated block or molded by casting on site. When the thermal insulation layer is air, no filler exists inside the interlocking building block. But when the laying of all interlocking building blocks in the space enclosed by each group of slab columns and slab beams is completed, the closed air layer inside the interlocking building blocks is a good and cheap thermal insulation layer. For the thermal insulation layer, the materials with different thermal coefficients and the construction methods can be selected according to the requirements of the architectural design, and the materials can be obtained locally to reduce the construction cost.

In a class of this embodiment, a thermal barrier is arranged at an inner side of the external faceplate or/and internal faceplate of the interlocking building block; and the thermal barrier is thermal insulating mortar, glass wool, rock wool, mineral wool, foam plastic, expanded perlite, foamed cement, or a mixture thereof. The arrangement of the thermal barrier aims to partition the heat exchange passages inside and outside the wall to adapt to the higher requirements to the thermal and heat insulation and energy saving in the building design. The materials can be obtained locally to reduce the construction cost.

In a class of this embodiment, a tongue-and-groove, a mortise and tenon, a bulge, or a groove is arranged on at least one end surface of the interlocking building block. The arrangement of the tongue-and-groove, the mortise and tenon, the bulge, or the groove aims to ensure that the interlocking building blocks are jointed more firmly and tightly to more effectively prevent leakage and isolate water vapor. The connection modes are determined according to the design requirements in order to stabilize the connection and simplify the construction methods.

In a class of this embodiment, a thermal insulation layer, a thermal barrier, a flexible shock absorption layer, or a combination thereof is arranged on at least one contact surface between the slab columns and/or the slab beams and the interlocking building blocks. In the thermal insulating wall in many applications or in the patent embodiment, the contradiction between the wall thermal insulation property and the wall strength is most difficulty solved. The large-area arrangement of the thermal insulation layer reduces the steadiness of the wall, the method for solving the problem is to arrange the slab columns or the slab beams, and the slab columns or the slab beams without the thermal barrier serve as heat bridge passages in the wall, so that the thermal insulation property of the integral wall is reduced. In order to solve the contradiction, the thermal insulation layer and the thermal barrier are arranged on the contact surfaces among the slab columns and/or the slab beams of the interlocking building blocks in the invention to cut off the heat bridge to the maximum limit to ensure that the wall achieves better thermal insulation effect. For the area where the earthquake and the typhoon frequently occur, the requirements of shock resistance to the building is higher, and the flexible shock absorption layers are arranged on the contact surfaces among the slab columns and/or the slab beams of the interlocking building blocks to enhance the wall shock resistance and steadiness.

In a class of this embodiment, the slab columns and the slab beams are connected through embedded welding, bolting, metalwork riveting, tenon splicing, local cast-in-place concrete connection, or a combination thereof. On the premise of simplifying the construction methods and reducing the construction cost, the suitable methods are selected to achieve the wall steadiness required in the design.

In a class of this embodiment, the slab column comprises a side slab column or/and a middle slab column, and the slab beam comprises upper and lower end slab beams or/and a middle slab beam.

In a class of this embodiment, the side slab columns are fixedly connected with a vertical component (wall or column) of a building or/and the upper and lower end slab beams are fixedly connected with a horizontal component (beam or floor slab); or a flexible airtight layer or flexible shock absorption layer is arranged between the side slab columns and the vertical component (wall or column) of the building or/and between the upper and lower end slab beams and the horizontal component (beam or floor slab). The arrangement of the flexible airtight layers aims to cut off the heat bridge passage between the wall, the column, the beam, the floor slab and the slab beam or the slab column or the internal faceplate to ensure that the thermal insulation property of the wall is not impacted by the objective components (wall, column, beam and floor slab) of the building; the arrangement of the flexible shock absorption layers aims to enhance the shock resistance property. The flexible airtight layers or the flexible shock absorption layers can be separately or jointly arranged according to the requirements of the building.

In a class of this embodiment, the side slab column, the middle slab column, the upper and lower end slab beams or/and the middle slab beam are made of plain concrete, reinforced concrete, shaped steel, alloy, high alloy, modified plastic refractory, anticorrosive wood strip, or a combination thereof. Different materials can be selected according to the requirements of the building to the wall strength and rigidity and the project cost.

In a class of this embodiment, a segmented or communicated drill way and outlet hole are arranged inside the side slab column, the middle slab column, the upper and lower end slab beam or/and the middle slab beam; or a chute is arranged on an outer surface on at least one side of the side slab column, the middle slab column, the upper and lower end slab beams or/and the middle slab beam. In the subsequent decoration for the traditional wall, wall cutting and excavation, wire pipe embedding and wall surface refilling and floating are required for buried wiring, the working procedure is complex, and the construction period is long. However, in the invention, the drill ways and the outlet holes are reserved inside the side slab columns, the middle slab columns, the upper and lower end slab beams or/and the middle slab beams to solve the wiring problem in the subsequent decoration, simplify the working procedure and save the time. The quantity and position can be customized and reserved according to the design requirements.

In a class of this embodiment, when two interlocking building blocks are adjacently spliced in the space enclosed by the slab columns and the slab beams and are connected with the slab columns or the slab beams, a line-shaped inserter is arranged at a splicing position of the interlocking building blocks; or when three or four interlocking building blocks are adjacently spliced in the space enclosed by the slab columns and the slab beams, a T-shaped, Y-shaped or cross-shaped inserter is arranged at the splicing position of the interlocking building blocks. The inserter is arranged between the building blocks to enhance the connection steadiness and the wall strength, rigidity and strain resistance properties to ensure that the combined wall forms an integral firm body.

In a class of this embodiment, the line-shaped inserter or the T-shaped, Y-shaped or cross-shaped inserter is connected with the slab columns or the slab beams through embedded welding, bolting, metalwork riveting, tenon splicing, local cast-in-place concrete connection, or a combination thereof; or the line-shaped inserter or the T-shaped, Y-shaped or cross-shaped inserter is made of precast concrete, precast reinforced concrete, precast stiffened mortar, engineering plastics, metalwork, anticorrosive woodwork, high alloy, or a combination thereof. The connecting way for the inserters and the slab columns or the slab beams, the materials and the fabrication methods can be selected according to the design requirement to the wall strength and rigidity. On the premise of achieving the design requirements, the purposes are to simplify the process and reduce the cost.

In a class of this embodiment, a hole or/and groove is arranged on at least one side edge of the external faceplate or/and the internal faceplate for the interlocking building block, more than two interlocking building blocks are fixed into a whole through a connecting rod inserted into the hole and a connecting sheet embedded into the groove, and the connecting rod and the connecting sheet are separately or jointly arranged. The arrangement of the holes, the grooves, the connecting rods, and the connecting sheets aims to further enhance the steady connection among the building blocks to ensure that all interlocking building blocks are connected to form a whole, so that the appearance is smooth, and the rigidity and strength are stronger. The connecting rods and the connecting sheets are separately arranged to facilitate fabrication and installation; the connecting rods and the connecting sheets are integrally prefabricated, so that the connecting effect is better.

In a class of this embodiment, at least one outer surface of the waffle slab interlocking wall is a smooth surface or at least one outer surface of the waffle slab interlocking wall is a rough surface. The smooth outer surface of the wall is convenient to plaster or overcoat in the decoration; the rough outer surface of the wall is suitable for pasting the surface material of the external wall, such as ceramic tiles.

In a class of this embodiment, a perforated injection hole is reserved on the slab columns, the slab beams, the side slab column, the middle slab column, the upper and lower end slab beams or/and the middle slab beam, and a movable hole cover is possibly arranged on the injection hole. The injection holes are used for injecting the plastic thermal insulting materials, for example, foaming, casting and molding polyphenylene compound, polystyrene, phenolic resin, foamed cement, and the like; after casting, the movable hole covers can be covered on the injection holes when necessary.

In a class of this embodiment, the shape of the interlocking building block is triangle, quadrilateral, pentagon, hexagon, octagon, or curve trapezoid; or the wall composed of the interlocking building blocks is spliced by opposite joints or breaking joints. The interlocking building blocks with different shapes can be selected according to the structural and appearance requirements of the wall to achieve the integral steadiness and elegancy of the wall.

Advantages of the invention are summarized below:

the waffle slab interlocking wall can transfer the load transversely and longitudinally to effectively enhance the load bearing and shear resistance properties of the wall, and the wall can take a share in building stress; a hollow design is adopted so that the wall is lighter than the traditional wall, the whole structure is firmer, and the shock resistance property is better; the waffle slab lattice partition makes the integrity and air tightness of the wall enhanced and the thermal and sound insulating properties better; with the flexible arrangement of the thermal insulation layer and the thermal barrier, the heat bridge passage can be obstructed to the maximum limit, and the weather resistance is good; the advanced subarea fire control concept not only meets the national fire control requirements to the buildings, but also reduce the loss caused by fire to the maximum limit; the simple splicing type construction method ensures the water free and dust free operation to be achieved, thereby being rapid, convenient, sanitary and environmental friendly, more saving the construction materials and reducing the construction cost.

The prefabricated thermal insulating blocks can be arranged inside the interlocking building blocks, and the thermal insulation layer can also be foamed and cast on site after the splicing of the interlocking building blocks is completed, so that the wall has good integrity and air tightness; crisscross slab columns and slab beams taking a share in building body stress ensure the interlocking building blocks in the enclosed area and the thermal insulating materials inside the interlocking building blocks to be naturally enclosed into a fire control area; even though the fire occurs on the wall in certain special situation, even burns through the faceplate of one interlocking building block to cause the thermal insulation layer to catch fire, all thermal insulation layers in the wall cannot take fire. This is an advanced design concept of subarea fire control.

The waffle slab interlocking wall of the invention has good integrity and air tightness, can take a share in building stress, and has good shock resistance property. If the purpose-made interlocking building blocks are used, the cold bridge can be fully obstructed, so that the waffle slab interlocking wall has good thermal insulation property and energy saving effect. The waffle slab interlocking wall is not required to be constructed with mortar or placed with concrete on site, and the water free and dust free operation can be achieved, so that the wall is convenient, sanitary and environmental friendly.

The waffle slab interlocking wall of the invention is suitable for the external wall as well as the partition wall and the common interior wall, whether the bearing wall or the non-bearing wall. Whether the thermal insulation layer or/and thermal barrier is/are required in the common interior wall can be selected; in the design of the non-bearing wall, the strength of the slab columns or/and slab beams can be slightly weakened.

The waffle slab interlocking wall of the invention is suitable for the areas with different climatic characteristics, which can be achieved by adjusting the thickness of the wall, especially the thickness or material of the thermal insulation layer in the interlocking building block. The waffle slab interlocking wall has good weather resistance.

Figure 1:
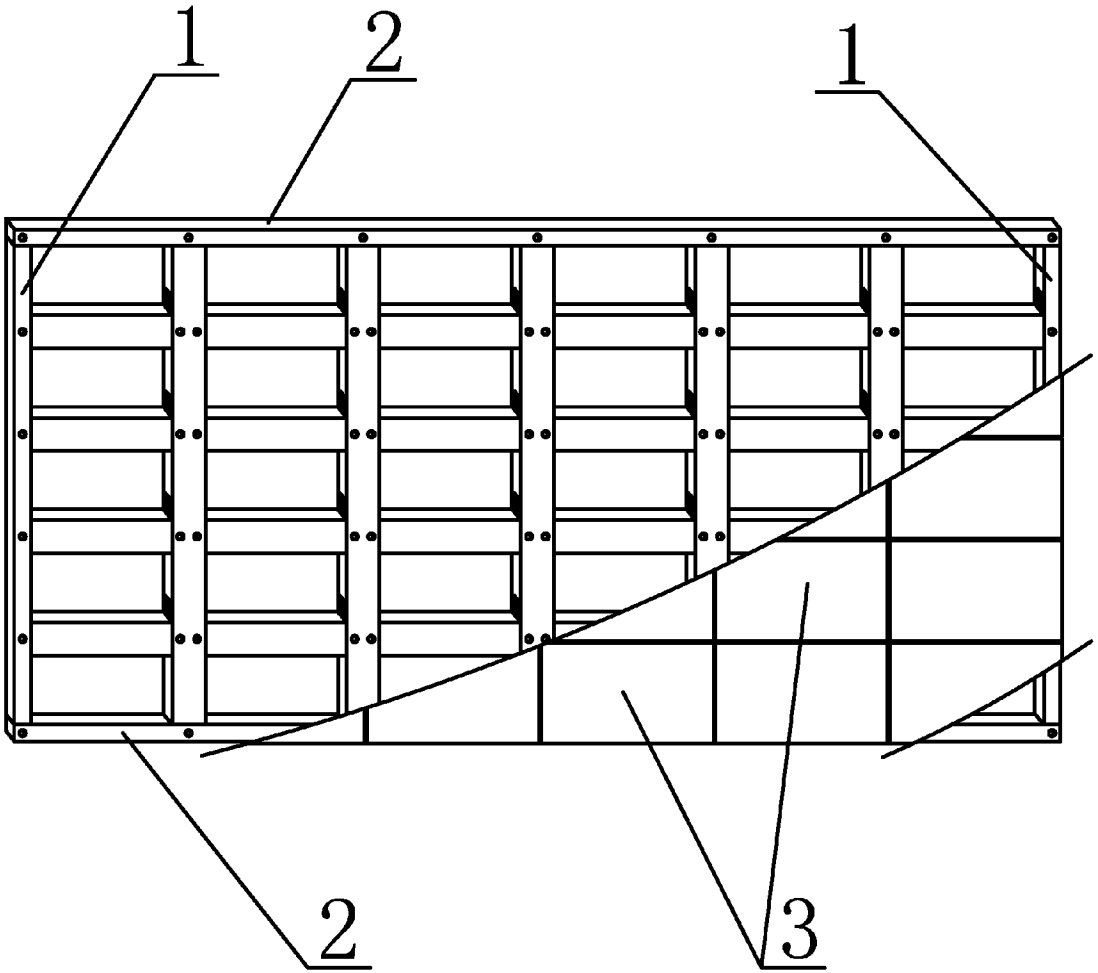
FIG. 1 is a schematic diagram of a waffle slab interlocking wall in accordance with a 1st embodiment of the invention.

In the drawings, the following reference numbers are used: 1 slab column, 2 slab beam, 3 interlocking building block, 4 external faceplate, 5 internal faceplate, 6 connecting piece, 7 thermal insulation layer, 8 thermal barrier, 9 flexible shock absorption layer, 10 tongue-and-groove, 11 mortise and tenon, 12 bulge, 13 gap, 14 side slab column, 15 middle slab column, 16 upper and lower end slab beam, 17 middle slab beam, 18 flexible air tightness layer, 19 drill way, 20 outlet hole, 21 chute, 22 line-shaped inserter, 23 T-shaped, Y-shaped, or cross-shaped inserter, 24 hole, 25 groove, 26 connecting rod, 27 connecting sheet, 28 injection hole, 29 movable hole cover, 30 main structure column, 31 main structure beam.

DETAILED DESCRIPTION OF THE EMBODIMENTS

To further illustrate the invention, experiments detailing a waffle slab interlocking wall are described below. It should be noted that the following examples are intended to describe and not to limit the invention.

Figure 2:
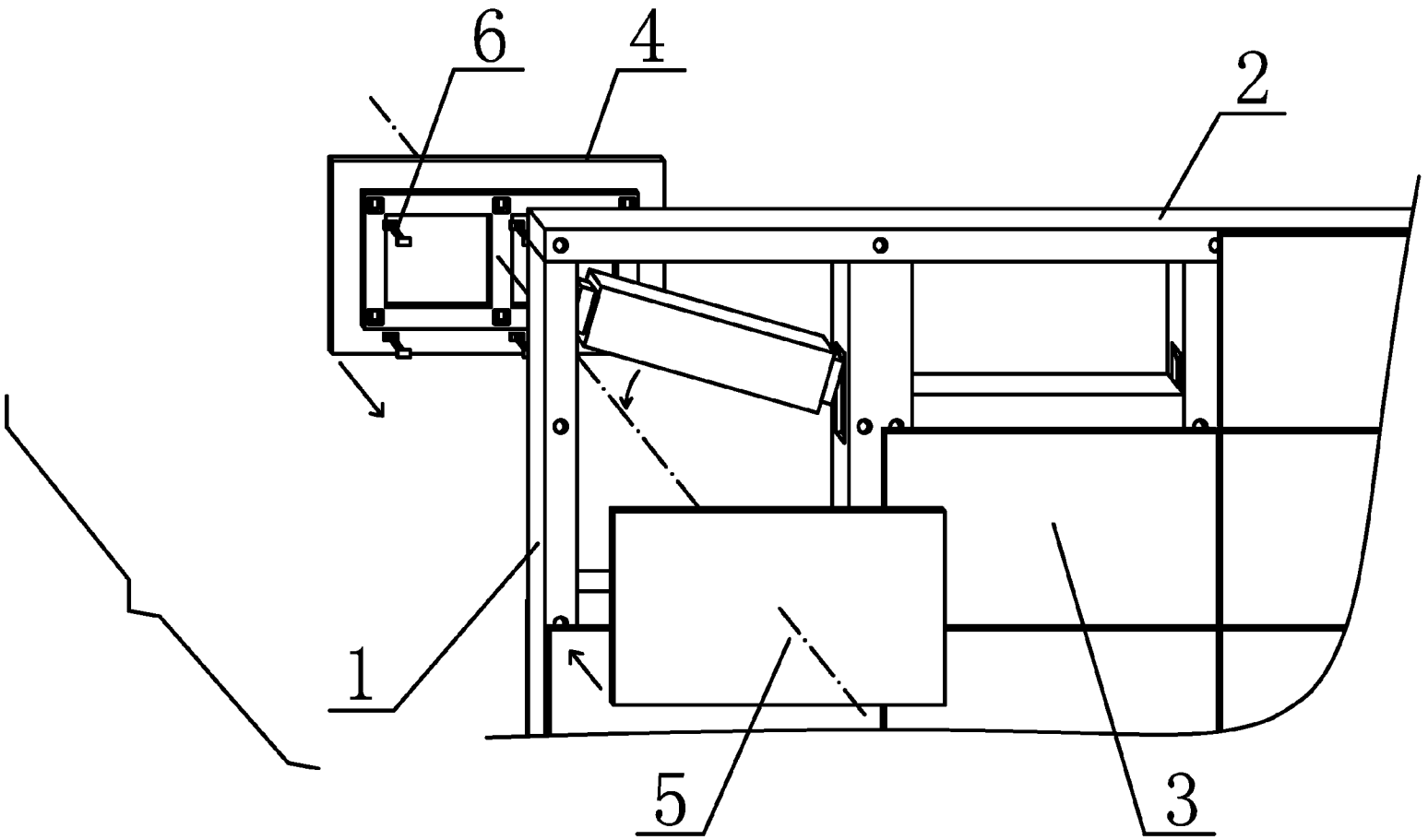
FIG. 2 is a schematic diagram of a waffle slab interlocking wall in accordance with a 2nd embodiment of the invention.

As shown in FIG. 1 and FIG. 2, a waffle slab interlocking wall comprises slab columns 1, slab beams 2 and interlocking building blocks 3. At least one interlocking building block 3 is embedded in a space enclosed by at least one slab column 1 and at least two slab beams 2 or by at least two slab columns 1 and at least one slab beam 2, and the interlocking building block 3 comprises an external faceplate 4 and an internal faceplate 5 which are spliced by a connecting piece 6. In the embodiment shown in FIG. 1, the slab columns 1 and the slab beams 2 enclose to form lattices in which the interlocking building blocks 3 are embedded to form the wall; in the embodiment shown in FIG. 2, the inlaying process of the interlocking building blocks 3 is shown: the external faceplate 4 and the internal faceplate 5 are moved inwards and then connected and fixed through the connecting piece 6 after being in place.

Figure 3:
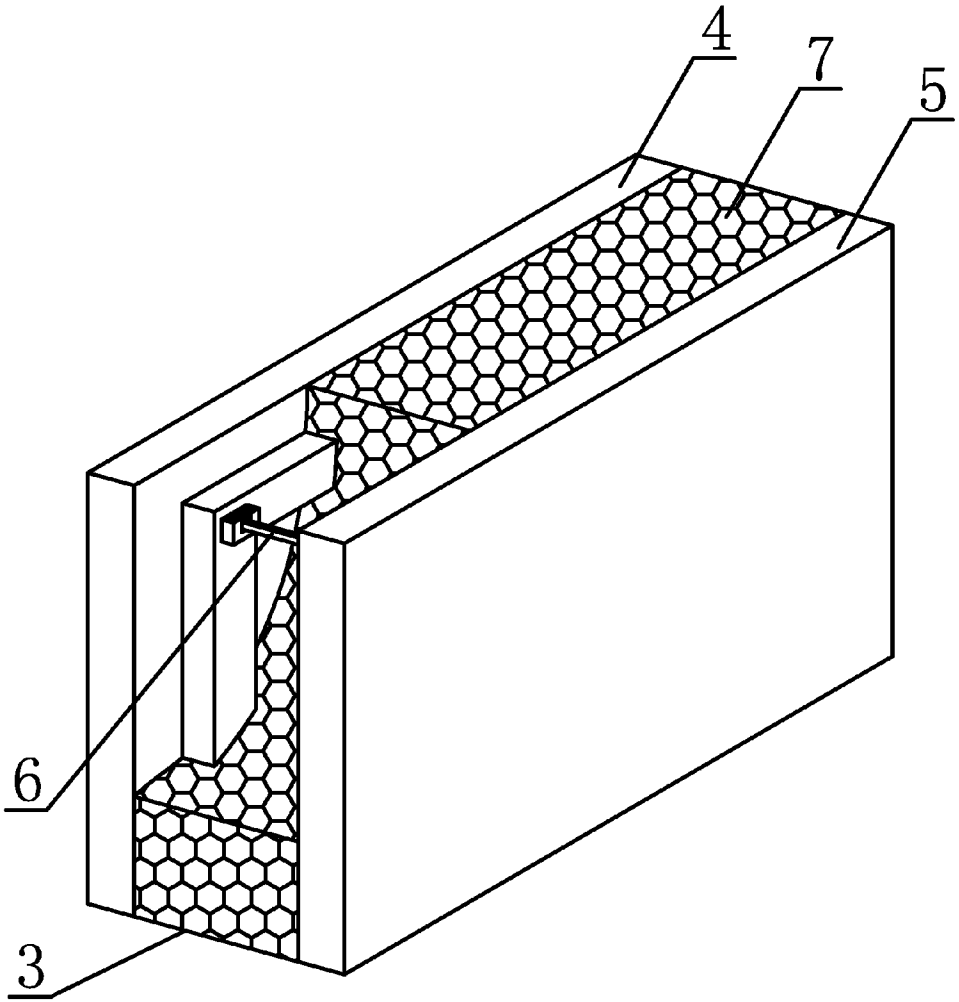
FIG. 3 is a schematic diagram of a waffle slab interlocking wall in accordance with a 3rd embodiment of the invention.

As shown in FIG. 3, the thermal insulation layer 7 is arranged between the external faceplate 4 and the internal faceplate 5 of the interlocking building block 3.

Figure 4:
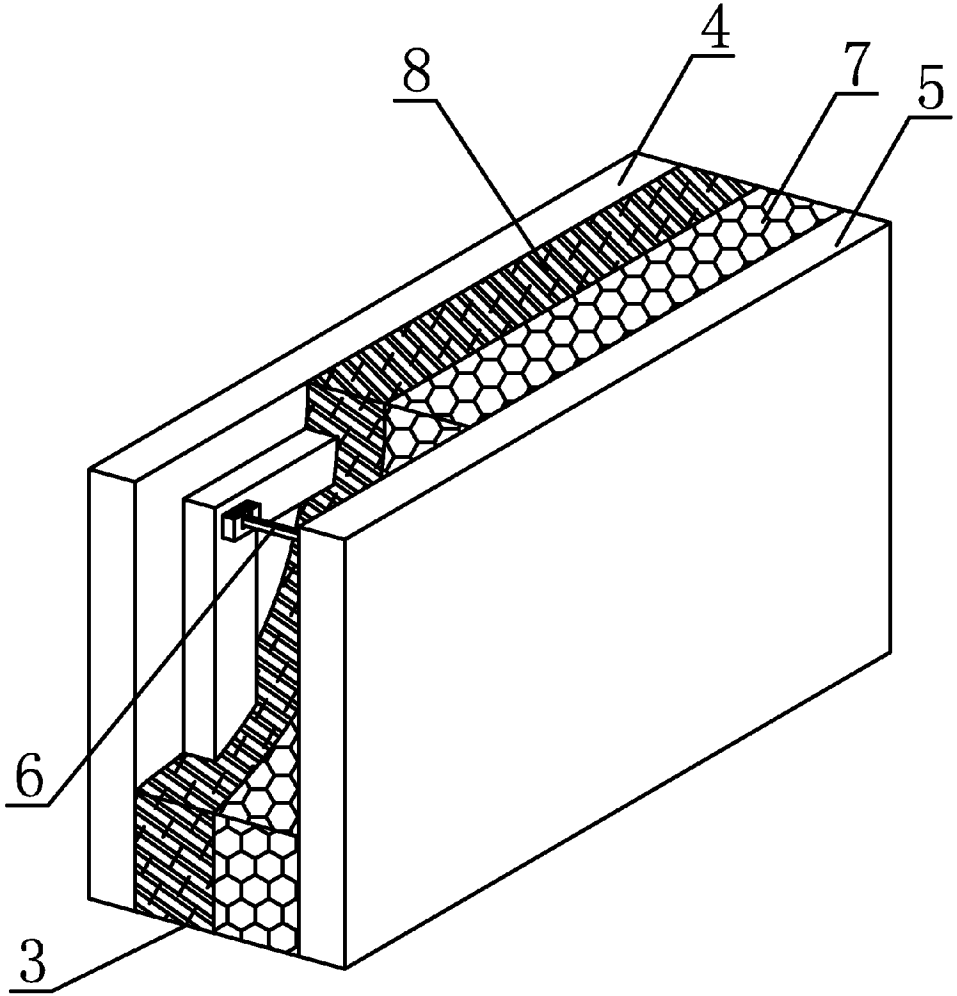
FIG. 4 is a schematic diagram of a waffle slab interlocking wall in accordance with a 4th embodiment of the invention.

As shown in FIG. 4, the thermal barrier 8 is arranged on the inside of the external faceplate 4 or/and internal faceplate 5 of the interlocking building block 3; or the thermal barrier 8 is at least one of thermal insulating mortar, glass wool, rock wool, mineral wool, foam plastic, expanded perlite and foamed cement. In the embodiment shown in FIG. 4, the thermal barrier 8 and the thermal insulation layer 7 are arranged on the inside of the external faceplate 4.

Figure 5:
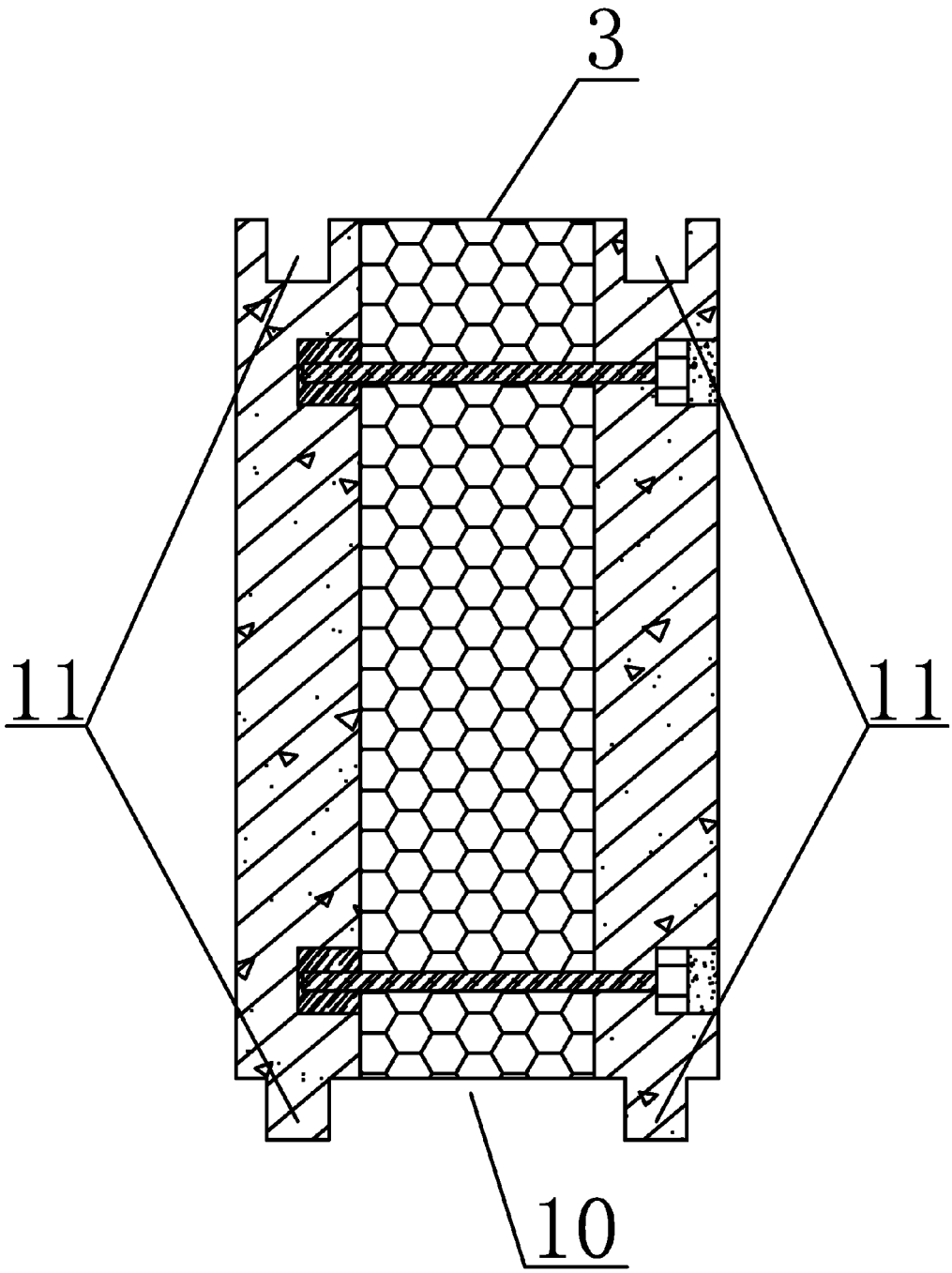
FIG. 5 is a schematic diagram of a waffle slab interlocking wall in accordance with a 5th embodiment of the invention.
Figure 6:
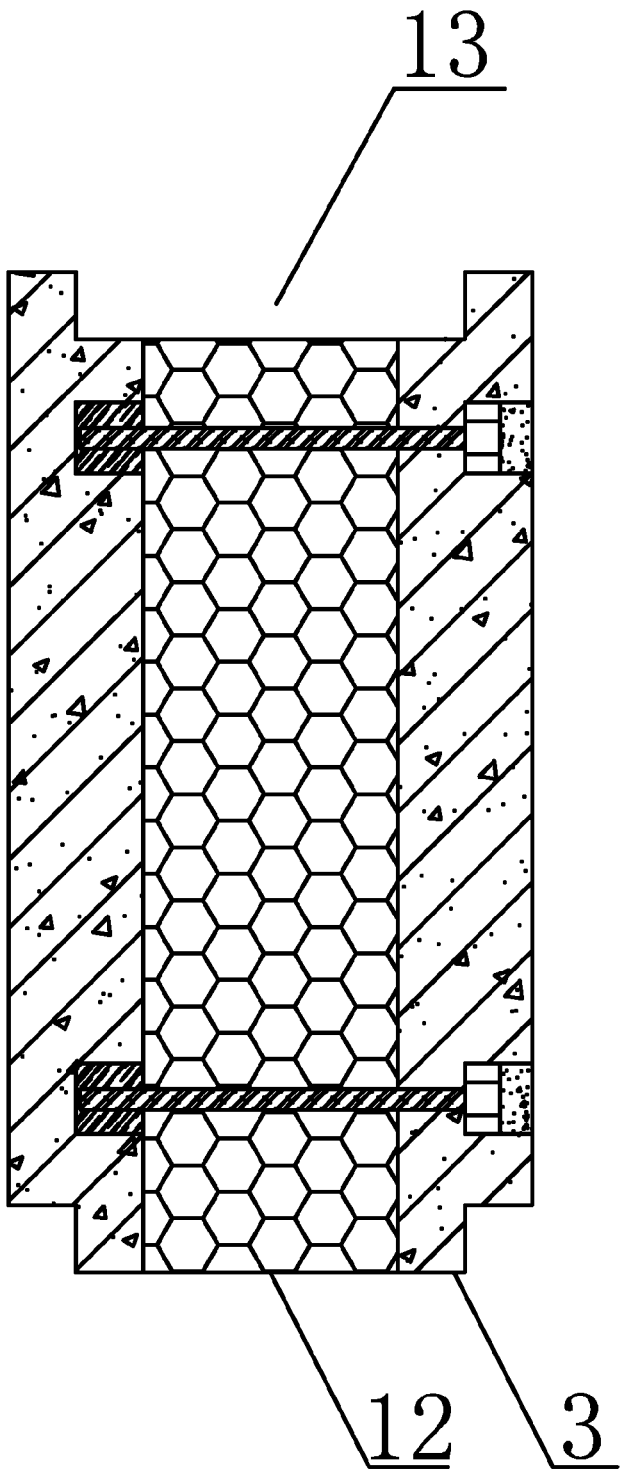
FIG. 6 is a schematic diagram of a waffle slab interlocking wall in accordance with a 6th embodiment of the invention.

As shown in FIG. 5 and FIG. 6, the tongue-and-groove 10, the mortise and tenon 11, the bulge 12 or the gap 13 is arranged on at least one end surface of the interlocking building block 3. In the embodiment shown in FIG. 5, the tongue-and-groove 10 is arranged on the front end surface of the interlocking building block 3, the paired mortise and tenons 11 are arranged on the front and rear plate ends of the external faceplate 4 and the internal faceplate 5; in the embodiment shown in FIG. 6, the bulge 12 is arranged on the front end surface of the interlocking building block 3. In the actual embodiment, the bulge 12 and the gap 13 can be designed into a mated embedding structure.

Figure 7:
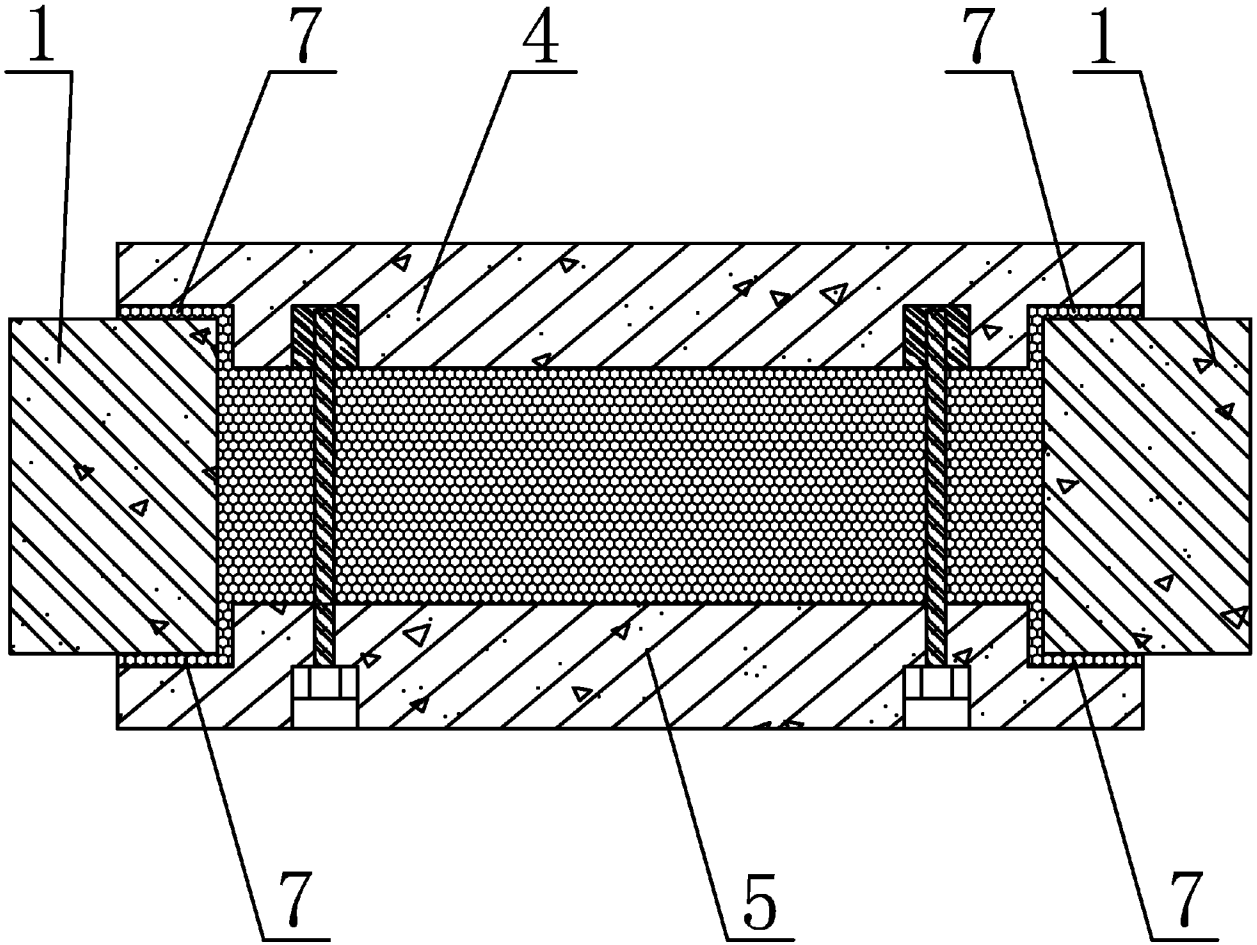
FIG. 7 is a schematic diagram of a waffle slab interlocking wall in accordance with a 7th embodiment of the invention.
Figure 8:
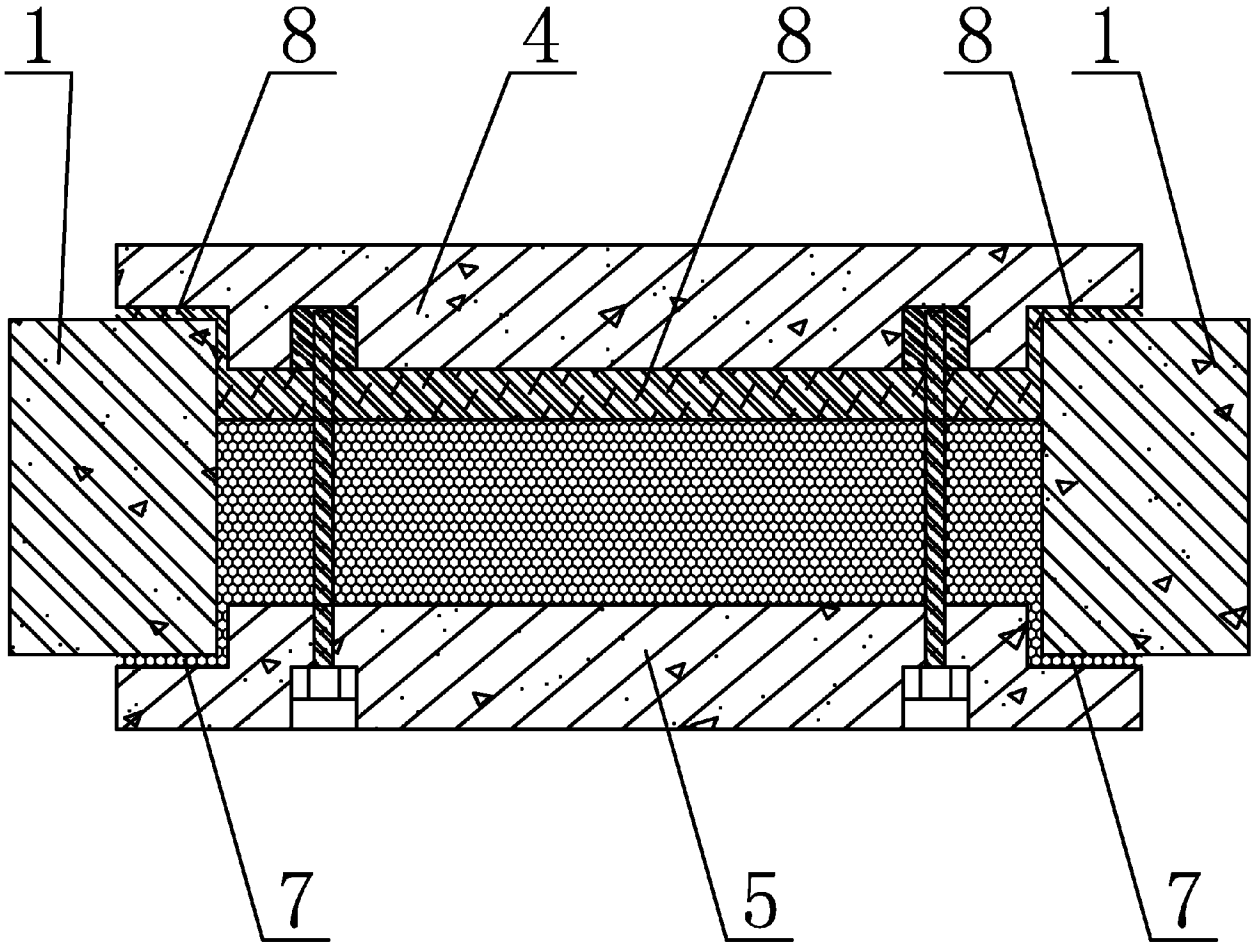
FIG. 8 is a schematic diagram of a waffle slab interlocking wall in accordance with a 8th embodiment of the invention.
Figure 9:
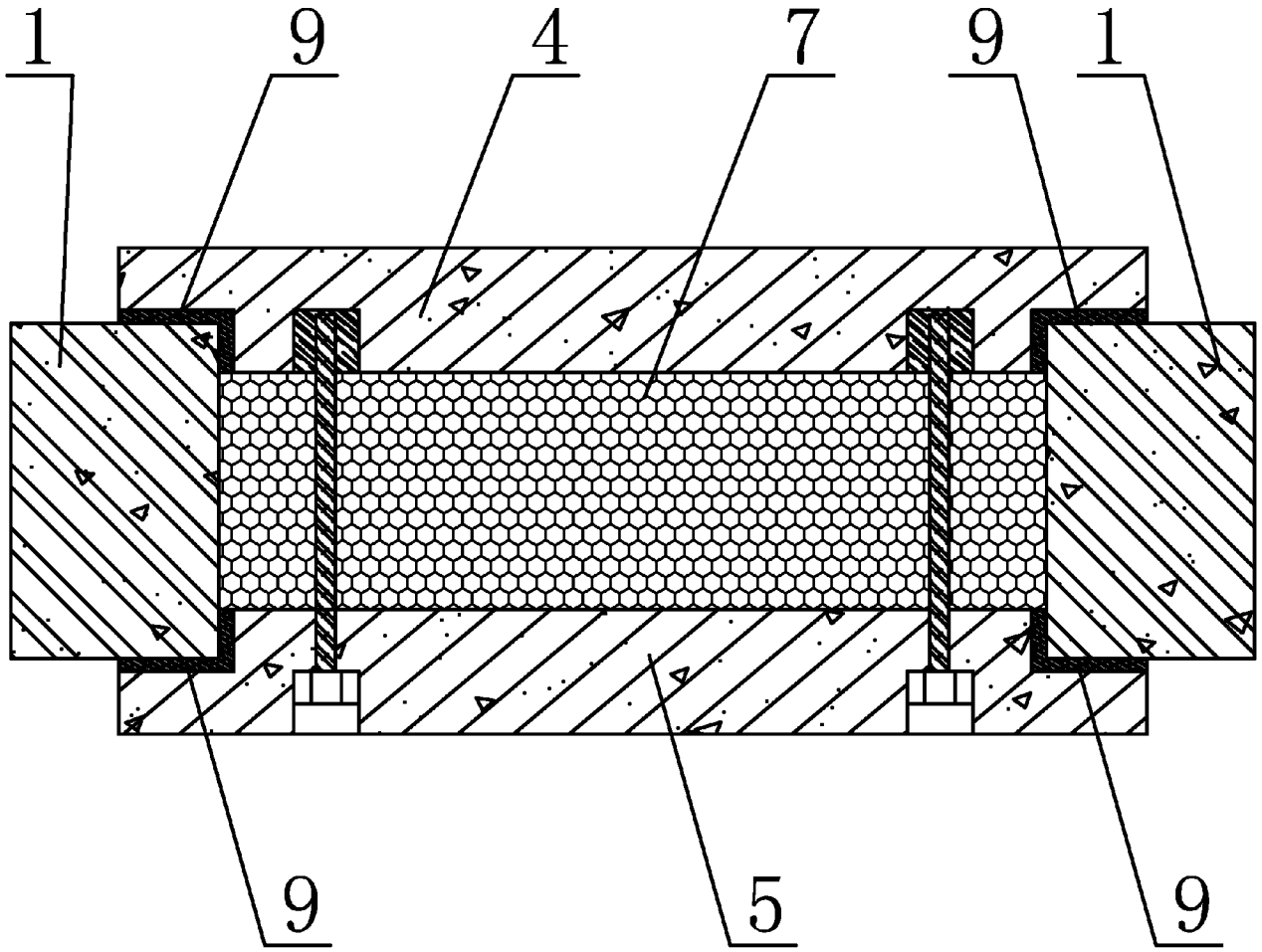
FIG. 9 is a schematic diagram of a waffle slab interlocking wall in accordance with a 9th embodiment of the invention.

As shown in FIGS. 7, 8, and 9, at least one of the thermal insulation layer 7, the thermal barrier 8 and a flexible shock absorption layer 9 is arranged on at least one contact surface among the slab columns 1 and/or the slab beams 2 of the interlocking building blocks 3. In the embodiment shown in FIG. 7, the thermal insulation layer 7 is arranged on the contact surface between the external faceplate 4 of the interlocking building block 3 and the slab column 1 and between the internal faceplate 5 of the interlocking building block 3 and the slab column 1, the thermal insulation layer 7 of the contact surface in the embodiment and the internal thermal insulation layer of the interlocking building block 3 are integrated, and the arrangement mode is achieved by on-site foaming. In the embodiment shown in FIG. 8, the thermal barrier 8 is arranged on the contact surface between the external faceplate 4 of the interlocking building block 3 and the slab column 1. In the embodiment shown in FIG. 9, the flexible shock absorption layer 9 is arranged on the contact surface between the external faceplate 4 of the interlocking building block 3 and the slab column 1 and between the internal faceplate 5 of the interlocking building block 3 and the slab column 1.

Figure 10:
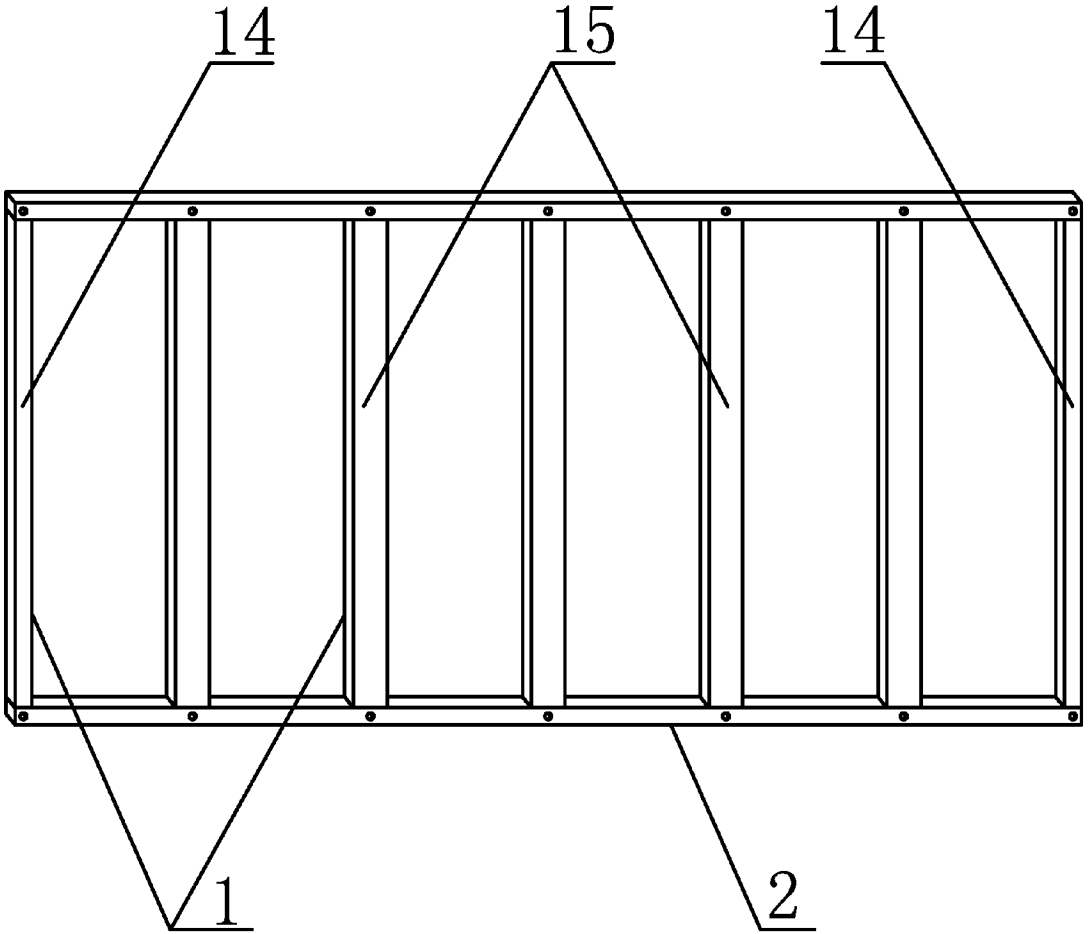
FIG. 10 is a schematic diagram of a waffle slab interlocking wall in accordance with a 10th embodiment of the invention.
Figure 11:
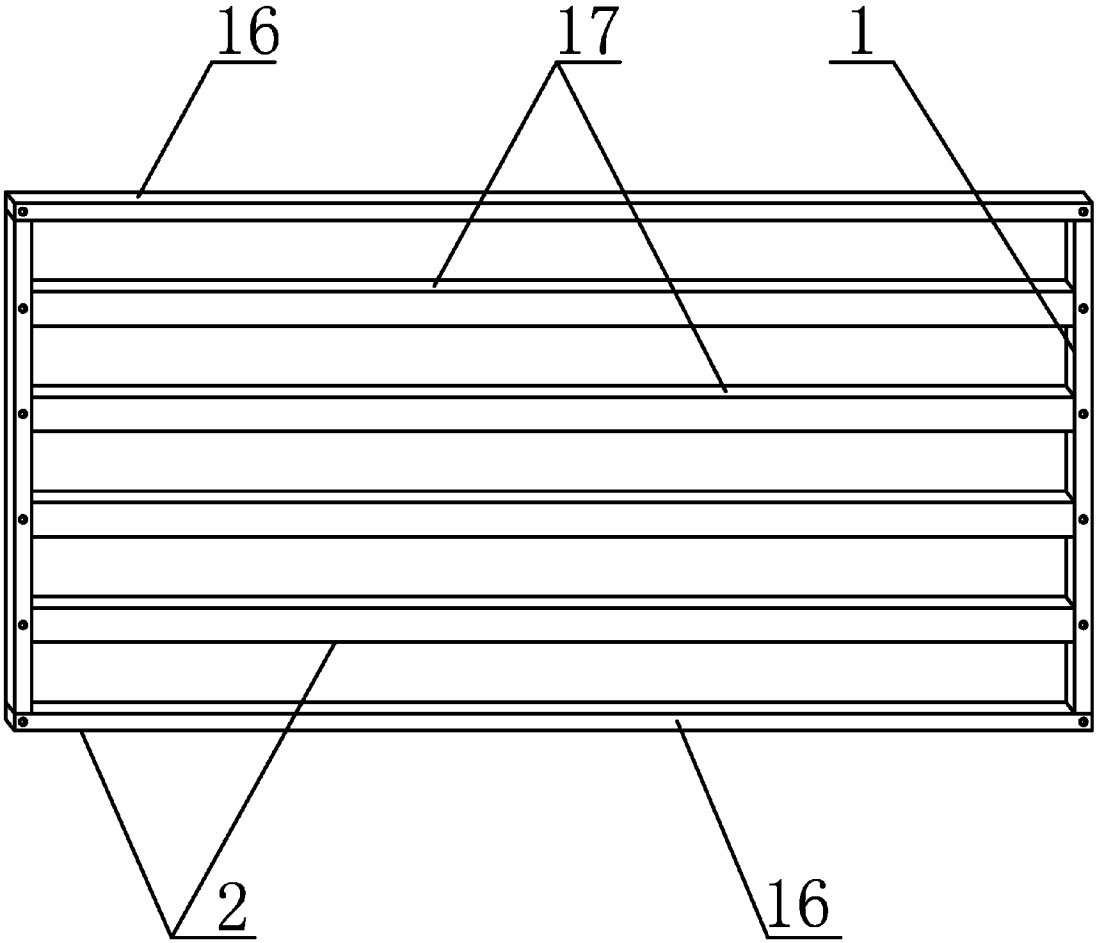
FIG. 11 is a schematic diagram of a waffle slab interlocking wall in accordance with a 11th embodiment of the invention.

As shown in FIGS. 10 and 11, the slab column 1 comprises a side slab column 14 or/and a middle slab column 15, and the slab beam 2 comprises upper and lower end slab beams 16 or/and a middle slab beam 17.

Figure 12:
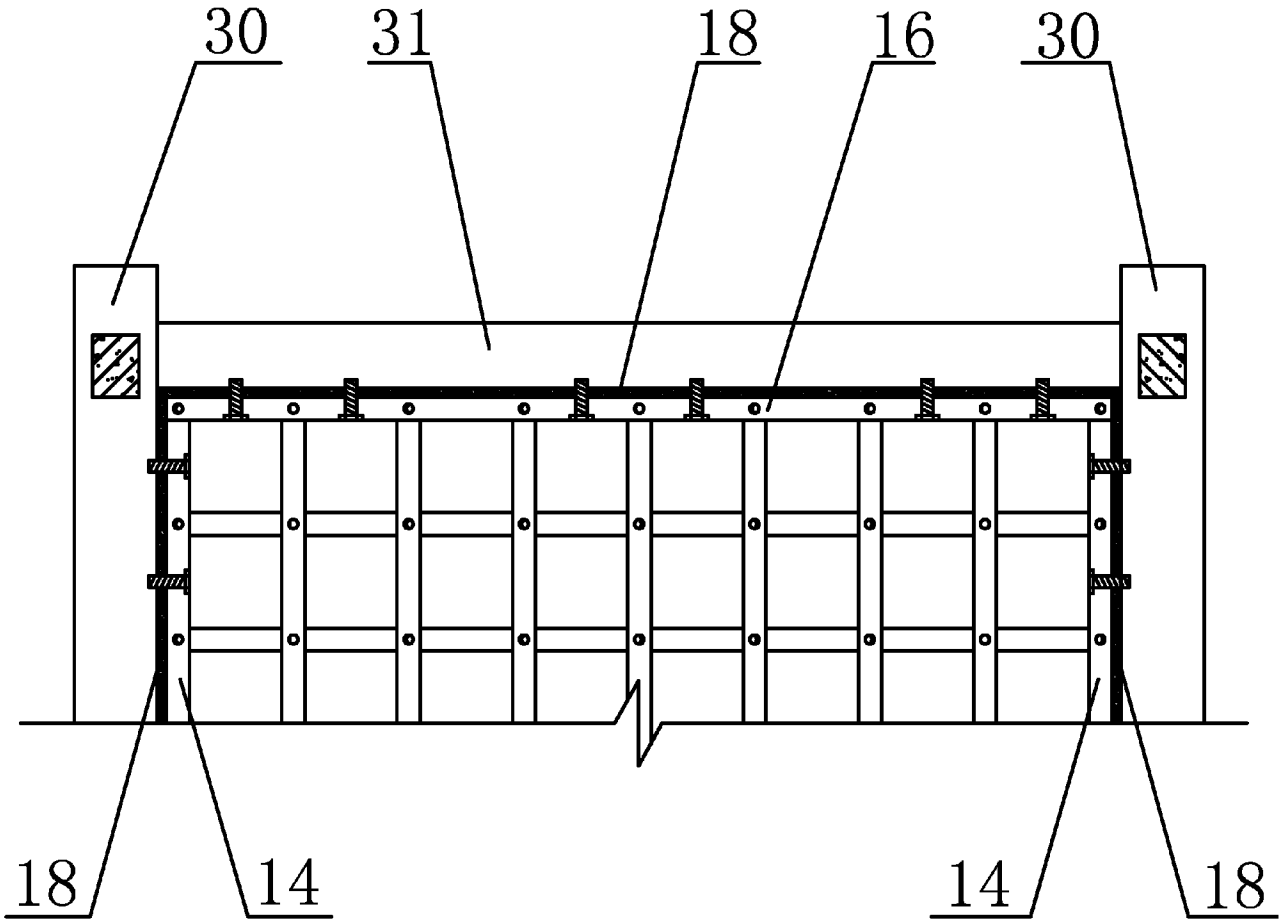
FIG. 12 is a schematic diagram of a waffle slab interlocking wall in accordance with a 12th embodiment of the invention.

As shown in FIG. 12, the side slab columns 14 are fixedly connected with vertical components (wall or column) of the building or/and the upper and lower end slab beams 16 are fixedly connected with horizontal components (beam or floor slab); or flexible airtight layers 18 or flexible shock absorption layers 19 are arranged between the side slab columns 14 and the vertical components (wall or column) of the building or/and between the upper and lower end slab beams 16 and the horizontal components (beam or floor slab). In the embodiment shown in FIG. 12, the side slab columns 14 are connected to the column 30 through bolts, the upper and lower end slab beams 16 are connected to the beam 31 through bolts, and the flexible airtight layers 18 are arranged between the side slab columns 14 and the column 30 and between the upper and lower end slab beams 16 and the beam 31.

Figure 13:
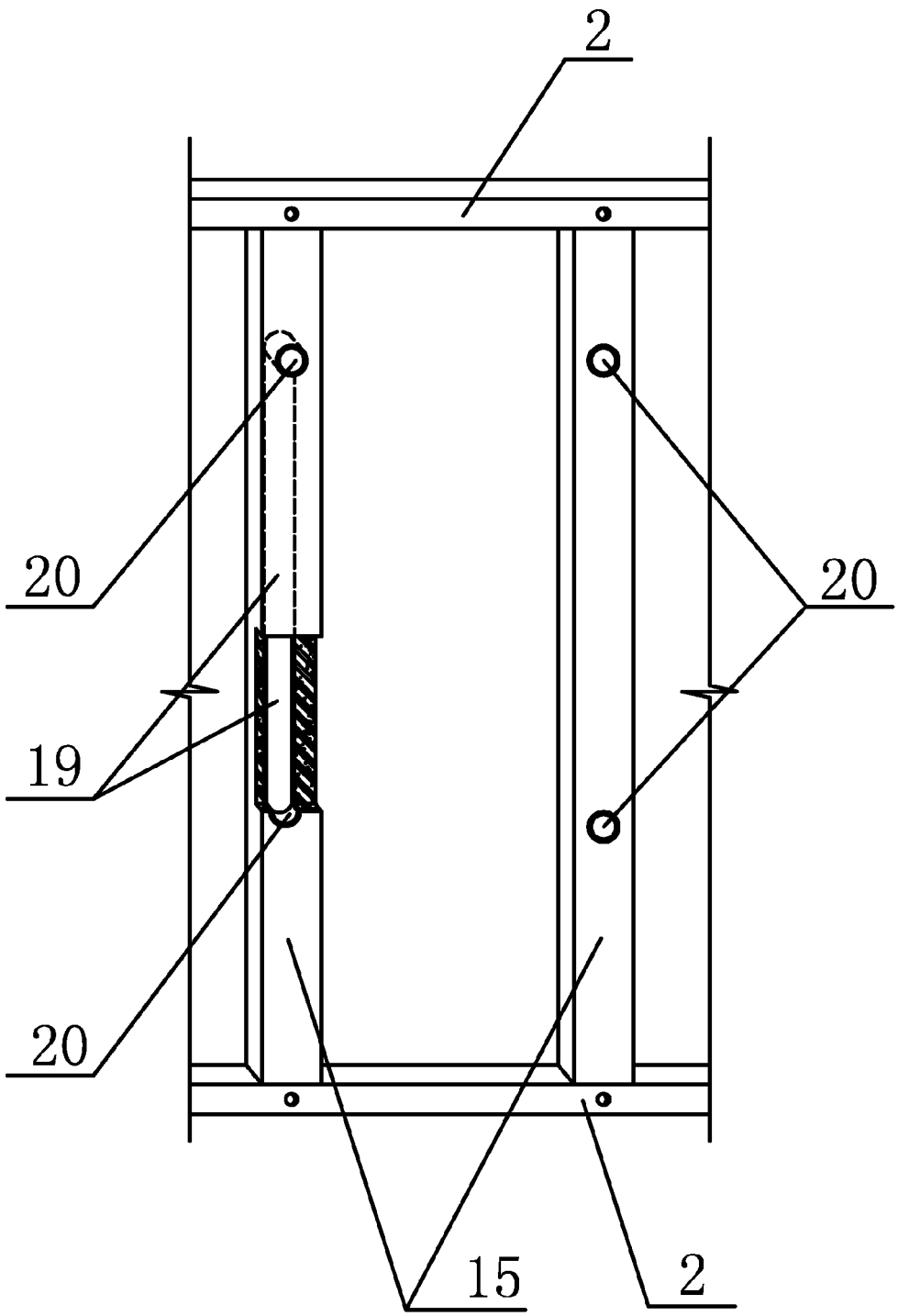
FIG. 13 is a schematic diagram of a waffle slab interlocking wall in accordance with a 13th embodiment of the invention.
Figure 14:
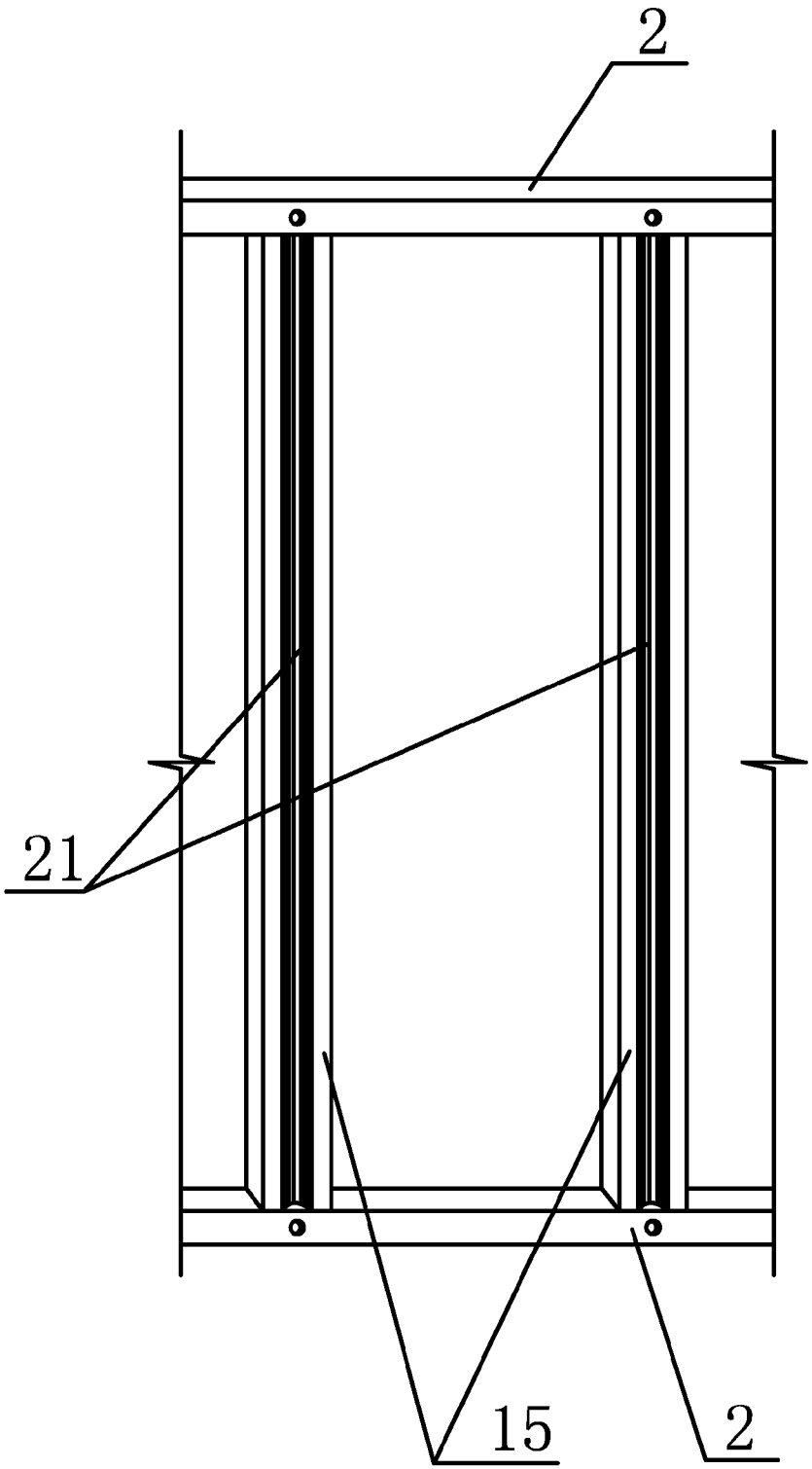
FIG. 14 is a schematic diagram of a waffle slab interlocking wall in accordance with a 14th embodiment of the invention.

As shown in FIGS. 13 and 14, segmented or communicated drill ways 19 and outlet holes 20 are arranged inside the side slab columns 14, the middle slab columns 15, the upper and lower end slab beams 16 or/and the middle slab beams 17; or chutes 21 are arranged on the outer surface on at least one side of the side slab columns 14, the middle slab columns 15, the upper and lower end slab beams 16 or/and the middle slab beams 17. In the embodiment shown in FIG. 13, the drill ways 19 are arranged inside the middle slab columns, and the outlet holes 20 are arranged on the surface of the column, through which the line can be conveniently led to the different positions of the wall. In the embodiment shown in FIG. 14, the sunken chutes 21 are arranged on the column surfaces of the middle slab columns 15, the difference from the arrangement of the drill ways 19 is that the threaded wire pipe can be directly buried in the chute 21; after the interlocking building blocks 3 are embedded, the wire pipe can be buried in the wall.

Figure 15:
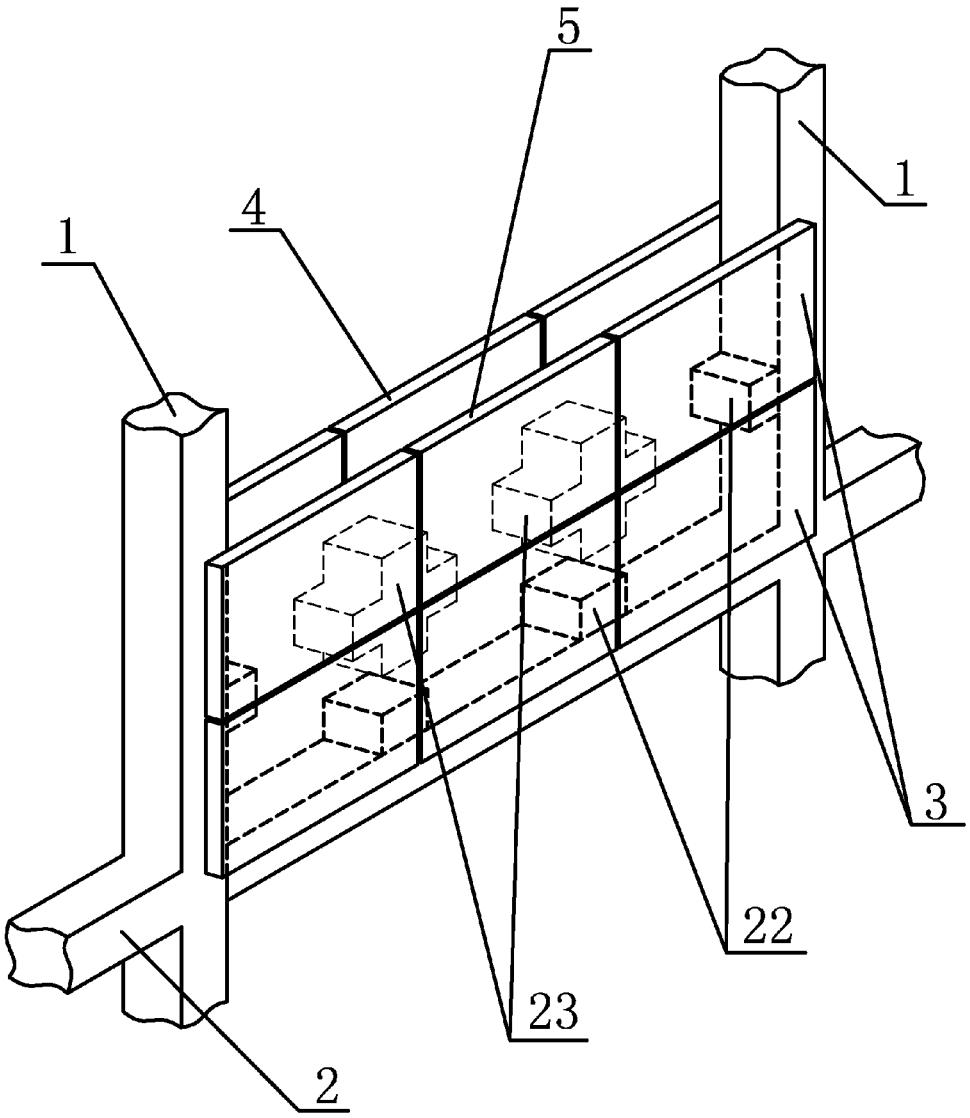
FIG. 15 is a schematic diagram of a waffle slab interlocking wall in accordance with a 15th embodiment of the invention.

As shown in FIG. 15, when two interlocking building blocks 3 are adjacently spliced in the space enclosed by the slab columns 1 and the slab beams 2 and are connected with the slab columns 1 or the slab beams 2, a line-shaped inserter 22 is arranged at the splicing position of the interlocking building blocks 3; or three or four interlocking building blocks 3 are adjacently spliced in the space enclosed by the slab columns 1 and the slab beams 2, a T-shaped, Y-shaped or cross-shaped inserter 23 is arranged at the splicing position of the interlocking building blocks 3. In the embodiment shown in FIG. 15, the line-shaped inserter 22 is arranged between two adjacent interlocking building blocks connected with the slab columns 1 or the slab beams 2 and is arranged between the external faceplate 4 and the internal faceplate 5; when the interlocking building blocks 3 are connected, the cross-shaped inserter is arranged at the splicing position.

Figure 16:
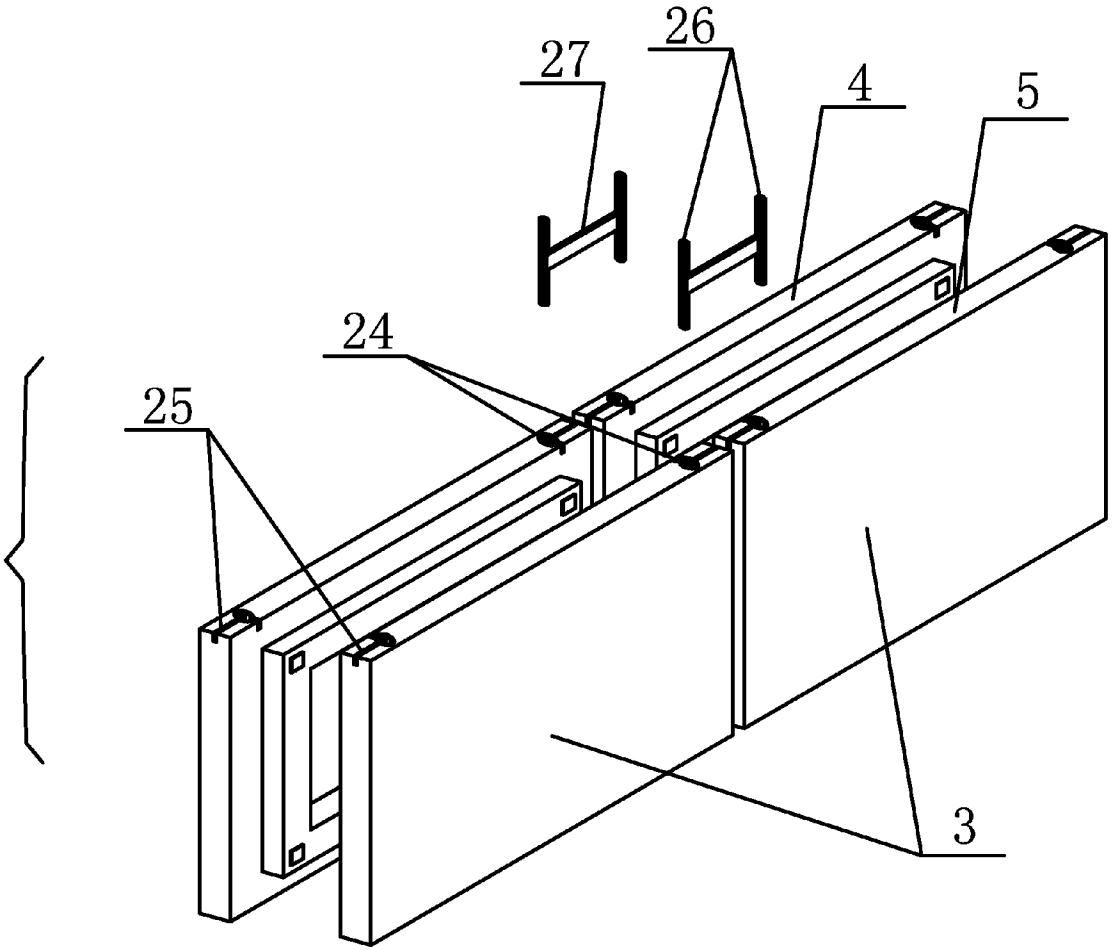
FIG. 16 is a schematic diagram of a waffle slab interlocking wall in accordance with a 16th embodiment of the invention.
Figure 17:
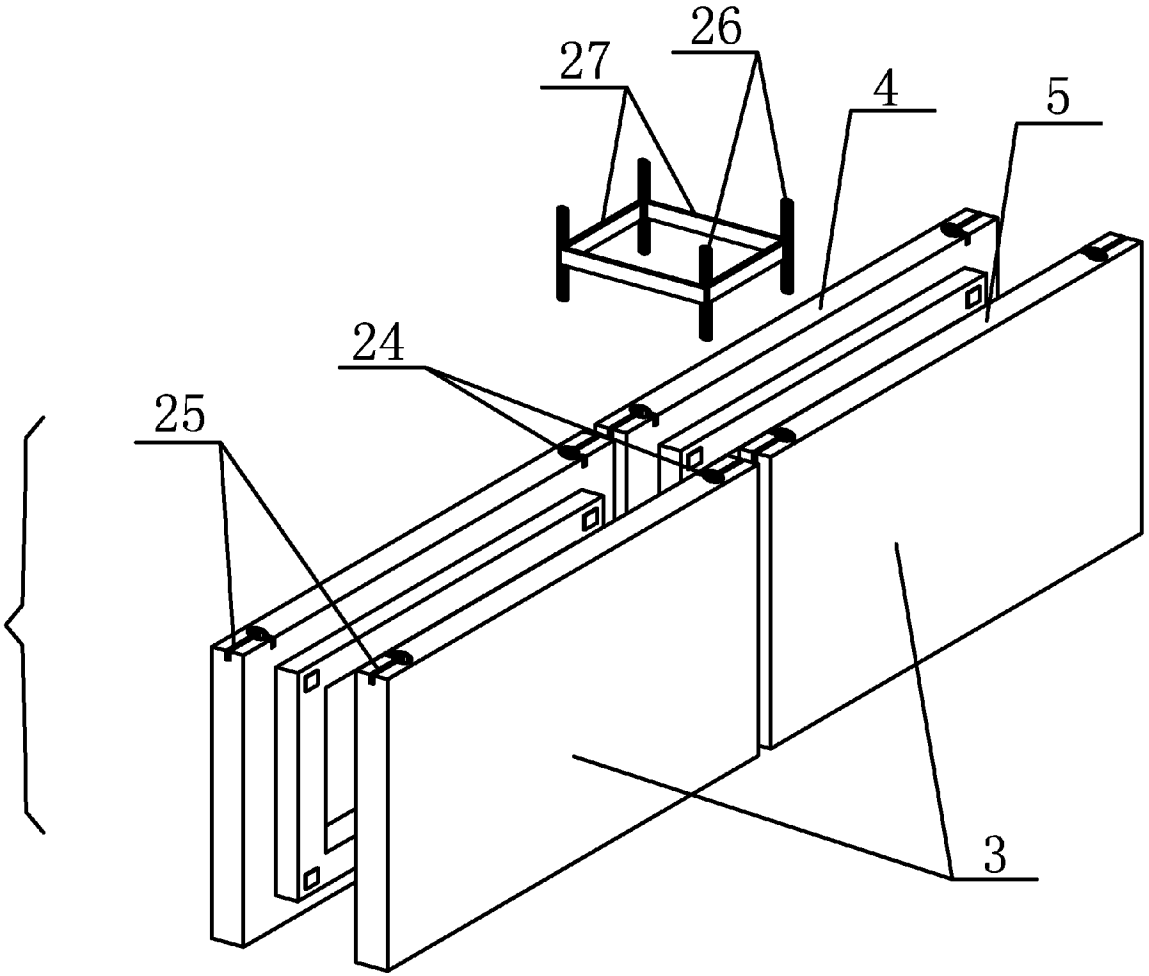
FIG. 17 is a schematic diagram of a waffle slab interlocking wall in accordance with a 17th embodiment of the invention.

As shown in FIGS. 16 and 17, holes 24 or/and grooves 25 are arranged on at least one side edge of the external faceplate 4 or/and the internal faceplate 5 for the interlocking building block 3, more than two interlocking building blocks 3 are fixed into a whole through connecting rods 26 inserted into the holes and connecting sheets 27 embedded into the grooves 25, and the connecting rods 26 and the connecting sheets 27 are separately or jointly arranged. In the embodiment shown in FIG. 16, the holes 24 and the grooves 25 are simultaneously arranged on two top sides of the external faceplate 4 and the internal faceplate 5; the connecting piece in the embodiment is composed of one connecting sheet 27 and two connecting rods 26 which are fixedly connected; in the operation, when the left and right interlocking building blocks 3 are embedded, the two connecting rods 26 are embedded into the adjacent holes 24, and the connecting sheets 27 are embedded into the adjacent grooves 25; in this process, the fixed connection of the left and right building blocks is finished; afterwards, the exposed connecting rods 26 and the connecting sheets 27 are embedded in the holes 24 and the grooves 25 in the building blocks above; this process is repeated till the building blocks are connected to form the whole wall. In the embodiment shown in FIG. 17, four connecting sheets 27 and four connecting rods 26 are connected to form a whole. Compared with the embodiment shown in FIG. 16, the building blocks are horizontally connected in a clamping way, and the internal faceplate 5 and the external faceplate 4 are internally and externally connected in a clamping way, so that the connection is firmer.

Figure 18:
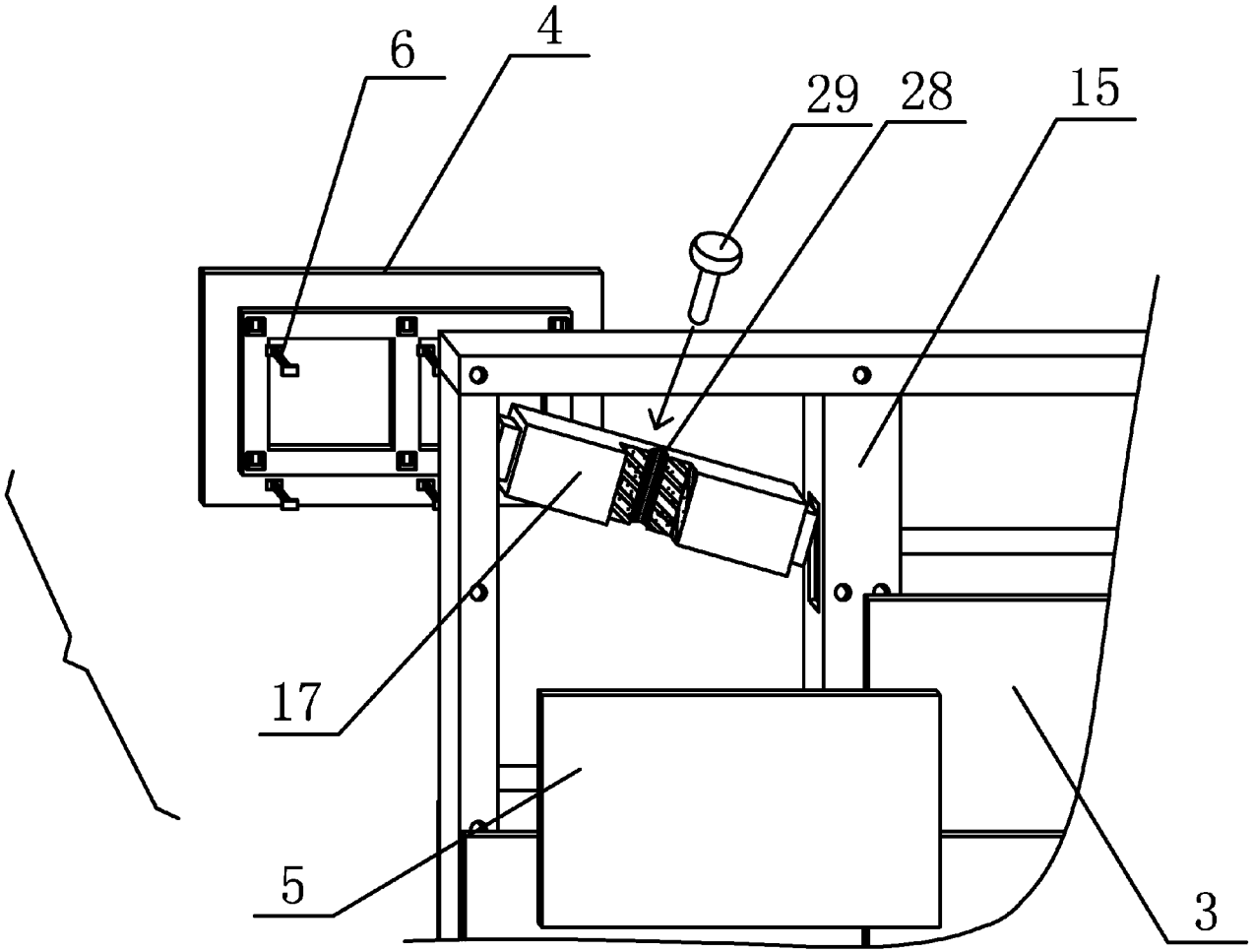
FIG. 18 is a schematic diagram of a waffle slab interlocking wall in accordance with a 18th embodiment of the invention.

As shown in FIG. 18, perforated injection hole 28 are reserved on the slab columns 1, the slab beams 2, the side slab columns 14, the middle slab columns 15, the upper and lower end slab beams 16 or/and the middle slab beams 17, and movable hole covers 29 are possibly arranged on the injection holes 28. In the embodiment shown in FIG. 18, the injection holes 28 are arranged in the middle slab beams 17, and the embodiment process is that the external faceplate 4 and the internal faceplate 5 are oppositely and inward moved to be attached to the two sides of the slab columns 1 and then connected and fixed by the connecting pieces 6, afterwards, the middle slab beams 17 are embedded between the external faceplate 4 and the internal faceplate 5. Then the plastic thermal insulting materials are injected into the injection holes 28. After casting, the movable hole covers 29 can be covered on the injection holes 28 when necessary.

As shown in FIGS. 19 to 23, the shape of the interlocking building block 3 is triangle, quadrilateral, pentagon, hexagon, octagon or curve trapezoid; or the wall composed of interlocking building blocks 3 can be spliced by opposite joints or breaking joints.

Figure 19:
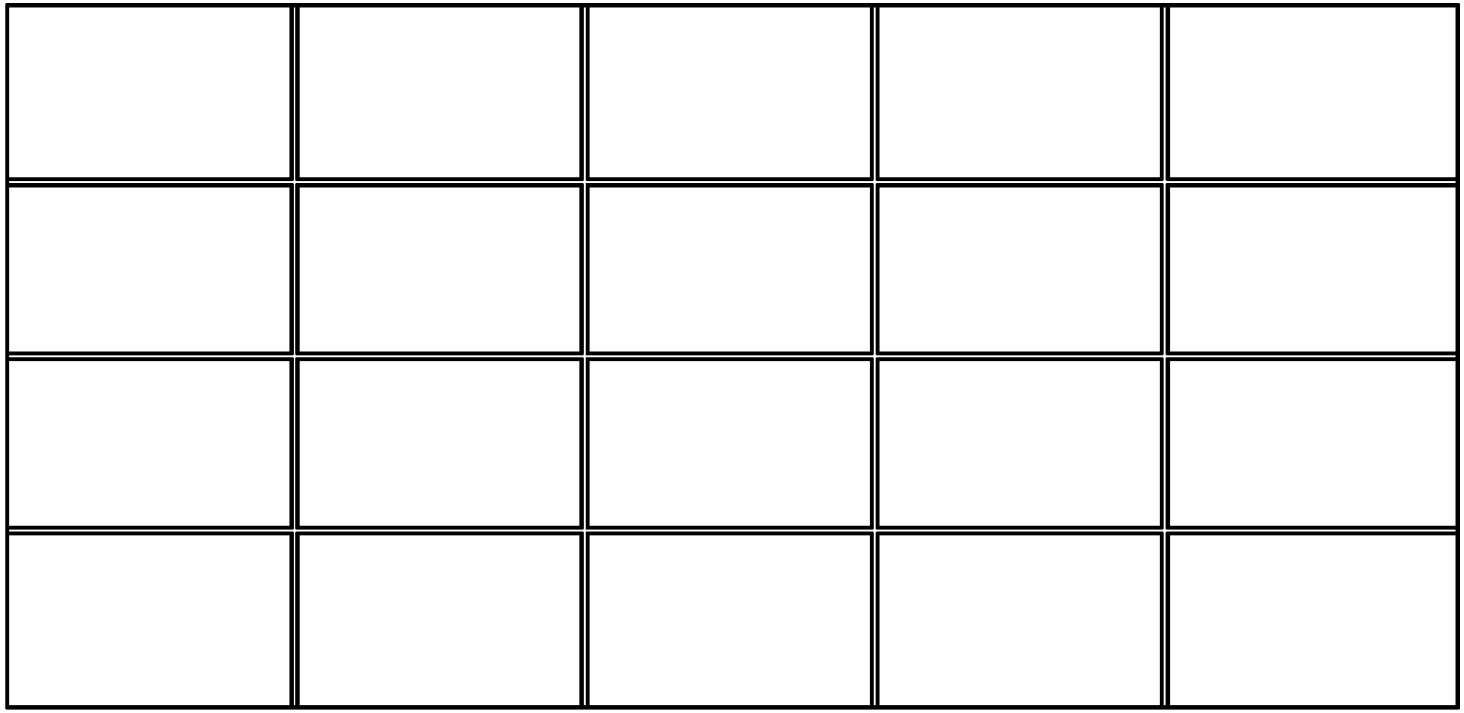
FIG. 19 is a schematic diagram of a waffle slab interlocking wall in accordance with a 19th embodiment of the invention.

As shown in FIG. 19, the interlocking building blocks 3 are spliced by opposite joints to form the wall, and the wall surface effect is shown in FIG. 19. This splicing way is most simple and decent, and is convenient for construction.

Figure 20:
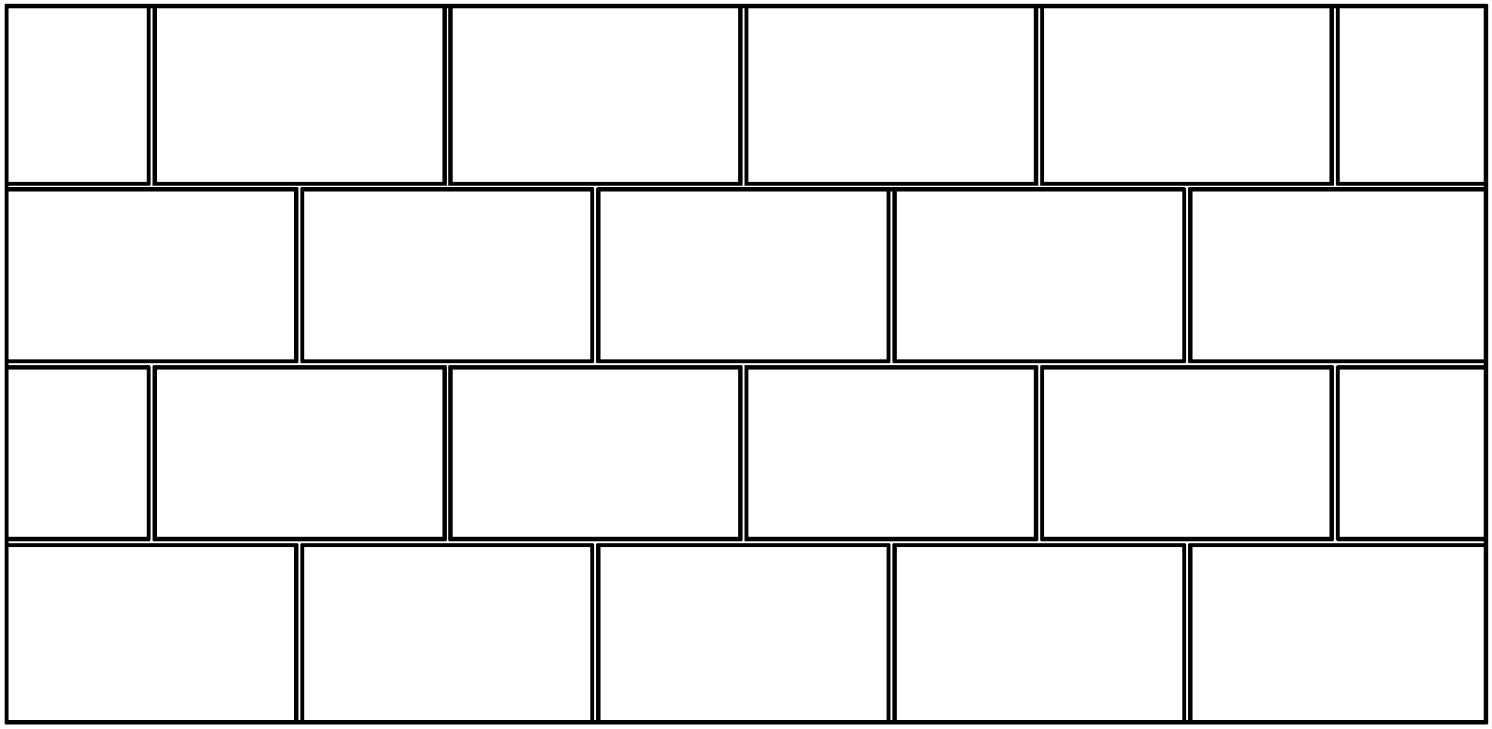
FIG. 20 is a schematic diagram of a waffle slab interlocking wall in accordance with a 20th embodiment of the invention.

As shown in FIG. 20, the interlocking building blocks 3 are spliced by breaking joints, and wall surface effect is shown in FIG. 20. This splicing way can effectively prevent the wall from generating the vertical interpenetrated crack and can ensure the facade of the external wall to be rich and colorful.

Figure 21:
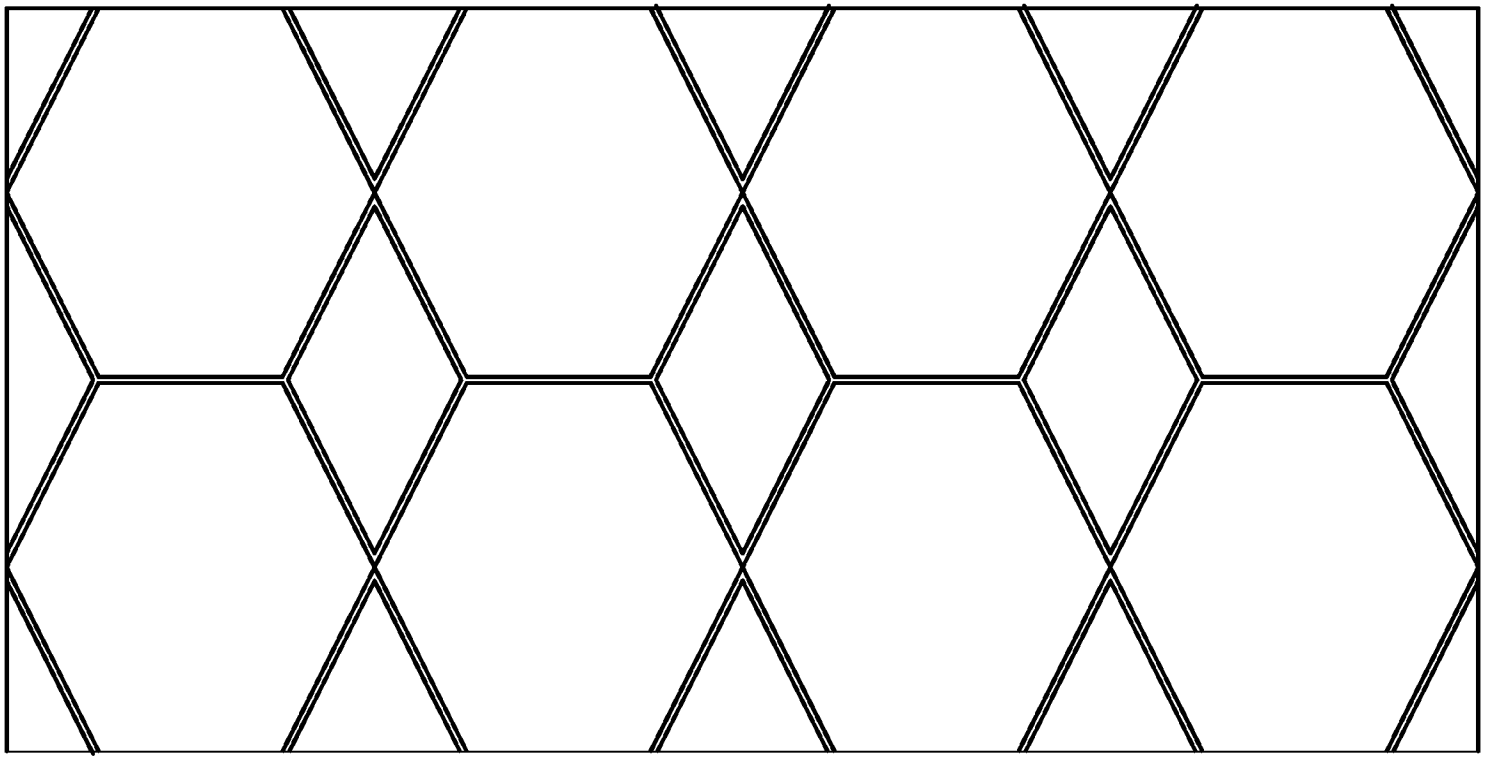
FIG. 21 is a schematic diagram of a waffle slab interlocking wall in accordance with a 21st embodiment of the invention.

As shown in FIG. 21, the shown wall is spliced by the triangular, quadrilateral and hexagonal interlocking building blocks 3.

Figure 22:
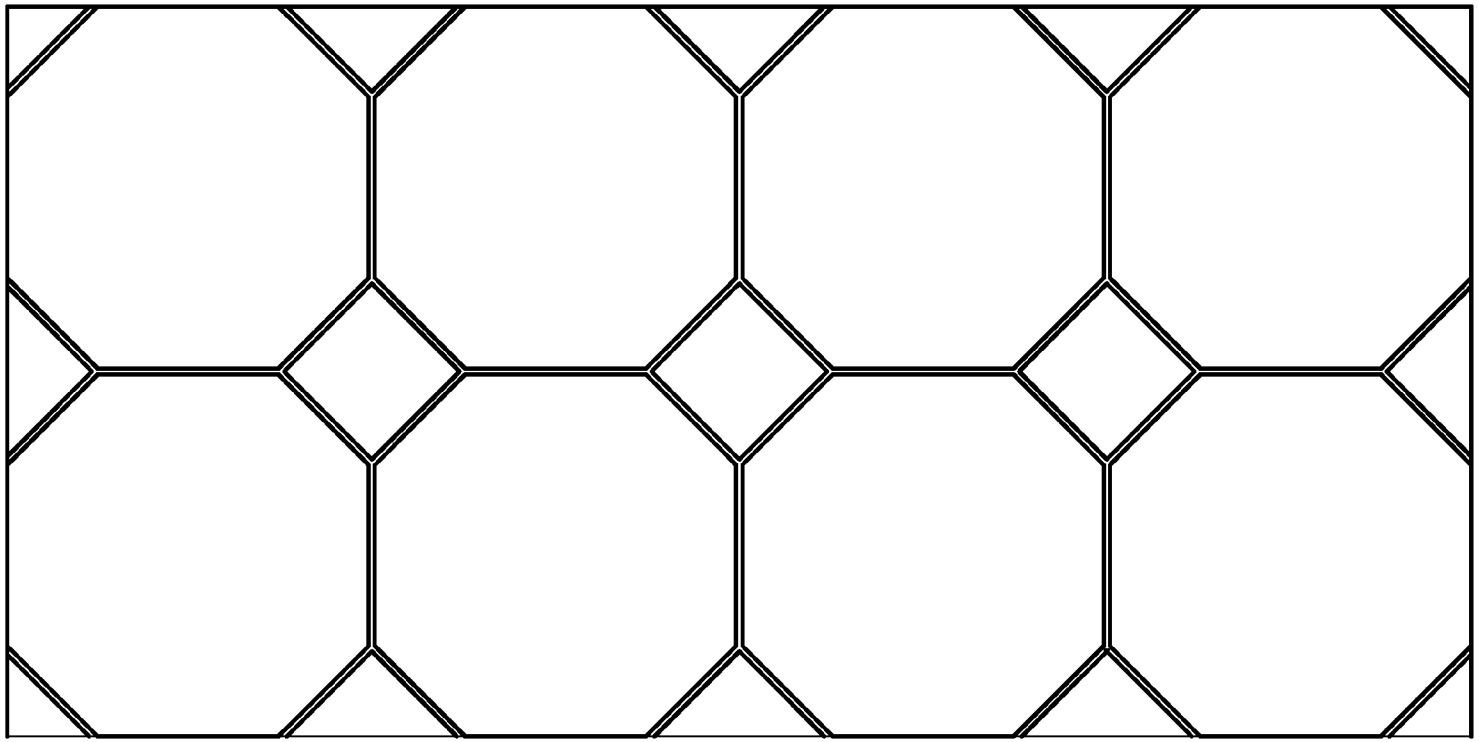
FIG. 22 is a schematic diagram of a waffle slab interlocking wall in accordance with a 22nd embodiment of the invention.

As shown in FIG. 22, the shown wall is spliced by the triangular, quadrilateral and octagonal interlocking building blocks 3.

Figure 23:
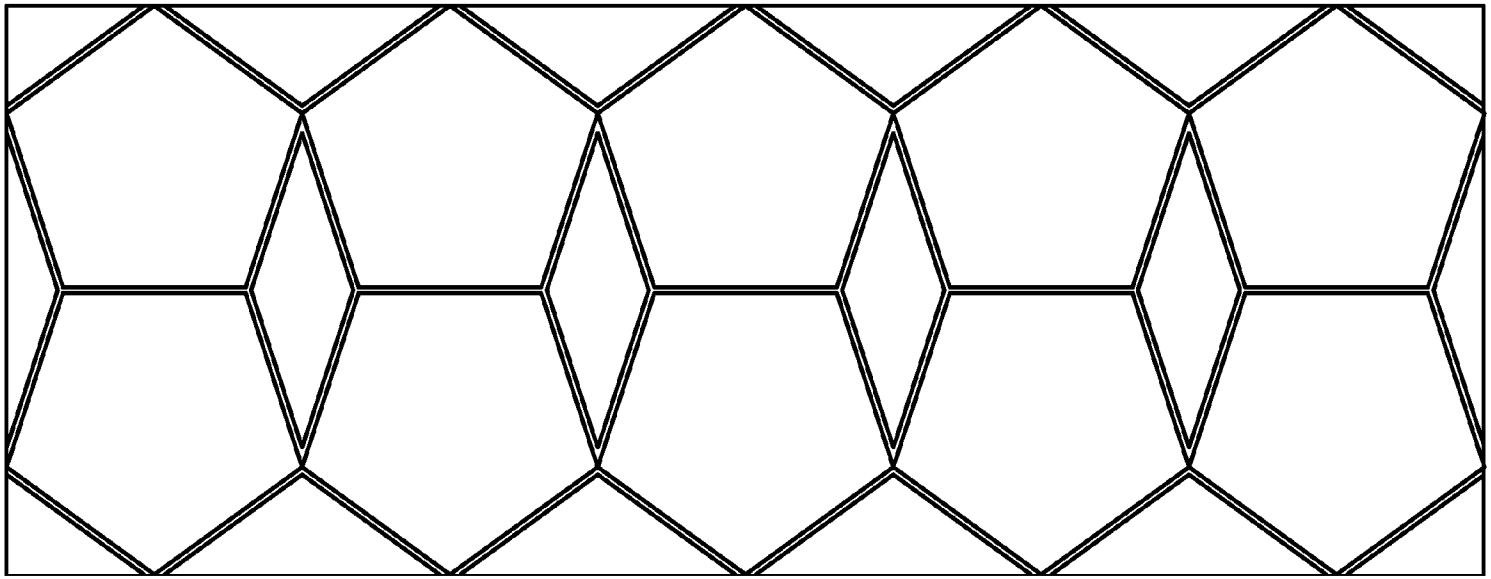
FIG. 23 is a schematic diagram of a waffle slab interlocking wall in accordance with a 23rd embodiment of the invention.

As shown in FIG. 23, the shown wall is spliced by the triangular, quadrilateral and pentagonal interlocking building blocks 3. By adopting the interlocking building blocks with different shapes for splicing, the wall facade requirements of different positions for different projects can be achieved.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A waffle slab interlocking wall, comprising:

a plurality of slab columns being spaced apart from each other;

a plurality of slab beams extending across said slab columns to form a plurality of spaces between said slab beams and said slab columns, wherein each of said slab columns and said slab beams has an external side and an internal side which is opposite to said external side;

a plurality of interlocking building blocks each comprising an external faceplate and an internal faceplate, wherein each of said external faceplates is attached on said external side of at least one of said slab columns and said slab beams to cover one of said spaces on said external side, wherein each of said internal faceplates is attached on said internal side of at least one of said slab columns and said slab beams to cover one of said spaces on said internal side, wherein said external faceplates and said internal faceplates are attached on said corresponding side of said slab beams and said slab columns in a side-by-side manner to form a wall structure;

a plurality of connecting pieces attaching on said interlocking building blocks respectively, wherein each of said connecting pieces extends through said interlocking building blocks to connect said corresponding external faceplate to said internal faceplates; and a thermal insulation layer providing between said external faceplates and said internal faceplates, wherein at least one of said interlocking building blocks has one of a tongue-and-groove, a mortise and tenon, a bulge, and a groove forming on an end surface of said corresponding interlocking building block.

2. A waffle slab interlocking wall, comprising:

a plurality of slab columns being spaced apart from each other;

a plurality of slab beams extending across said slab columns to form a plurality of spaces between said slab beams and said slab columns, wherein each of said slab columns and said slab beams has an external side and an internal side which is opposite to said external side;

a plurality of interlocking building blocks each comprising an external faceplate and an internal faceplate, wherein each of said external faceplates is attached on said external side of at least one of said slab columns and said slab beams to cover one of said spaces on said external side, wherein each of said internal faceplates is attached on said internal side of at least one of said slab columns and said slab beams to cover one of said spaces on said internal side, wherein said external faceplates and said internal faceplates are attached on said corresponding side of said slab beams and said slab columns in a side-by-side manner to form a wall structure;

a plurality of connecting pieces attaching on said interlocking building blocks respectively, wherein each of said connecting pieces extends through said interlocking building blocks to connect said corresponding external faceplate to said internal faceplates; and a thermal insulation layer providing between said external faceplates and said internal faceplates, wherein said waffle slab interlocking wall further comprises a plurality of connecting rods and at least one connecting sheet connecting said connecting rods, wherein at least two adjacent said external faceplates or two adjacent internal faceplates has two holes and two grooves respectively, wherein said connecting rods are arranged to receive in said holes, while said connecting sheet is received in said grooves.

3. A waffle slab interlocking wall, comprising:

a plurality of slab columns being spaced apart from each other;

a plurality of slab beams extending across said slab columns to form a cross structure between said slab columns and said slab beams;

a plurality of interlocking building blocks adjacently splicing on said slab beams and said slab columns;

a plurality of connecting pieces attaching on said interlocking building blocks respectively, wherein each of said connecting pieces extends through said interlocking building blocks to connect said corresponding interlocking building blocks to said corresponding slab beams and said slab columns; and an inserter providing between said slab columns and said slab beams at a splicing position of at least two interlocking building blocks for reinforcing a connection of said corresponding interlocking building blocks, wherein said inserter is at least one of line-shaped and cross-shaped, said inserter being connected with said corresponding slab column and said slab beam through at least one of embedded welding, bolting, metalwork riveting, tenon splicing, and local cast-in-place concrete connection, said inserter being configured from at least one of precast concrete, precast reinforced concrete, precast stiffened mortar, engineering plastics, metalwork, anticorrosive woodwork, and high alloy.

4. The waffle slab interlocking wall of claim 3, wherein each of said interlocking building blocks comprises an external faceplate and an internal faceplate, wherein each of said external faceplates is attached on an external side of at least one of said slab columns and said slab beams, wherein each of said internal faceplates is attached on an internal side of at least one of said slab columns and said slab beams.

* * * * *